US012624539B2

(12) United States Patent
Shinohara et al.

(10) Patent No.: US 12,624,539 B2
(45) Date of Patent: May 12, 2026

(54) WALL-MOUNTED FLUSH TOILET

(71) Applicant: TOTO LTD., Kitakyushu (JP)

(72) Inventors: Yuuki Shinohara, Kitakyushu (JP); Hiroshi Hashimoto, Kitakyushu (JP); Yuya Miyake, Kitakyushu (JP)

(73) Assignee: Toto Ltd., Fukuoka (JP)

( * ) Notice: Subject to any disclaimer, the term of this patent is extended or adjusted under 35 U.S.C. 154(b) by 213 days.

(21) Appl. No.: 18/419,149

(22) Filed: Jan. 22, 2024

(65) Prior Publication Data

US 2024/0287781 A1 Aug. 29, 2024

(30) Foreign Application Priority Data

Feb. 28, 2023 (JP) ..... 2023-029899
Feb. 28, 2023 (JP) ..... 2023-029901
Feb. 28, 2023 (JP) ..... 2023-029902

(51) Int. Cl.
*E03D 11/14* (2006.01)

(52) U.S. Cl.
CPC ..... *E03D 11/14* (2013.01)

(58) Field of Classification Search
CPC ..... E03D 11/00; E03D 11/02; E03D 11/14
USPC ..... 4/420, 661, 252.2, 901, 902
See application file for complete search history.

(56) References Cited

U.S. PATENT DOCUMENTS

2003/0126677 A1 7/2003 Idota et al.
2013/0223083 A1 8/2013 Kimiya et al.
2017/0296687 A1 10/2017 Hatta et al.

FOREIGN PATENT DOCUMENTS

CN 108071154 A 10/2020
JP 01223232 A 9/1989
JP H02129611 U 10/1990
JP H08284232 A 10/1996
JP 2002004384 A 1/2002
JP 2002119442 A 4/2002
JP 2007197899 A 8/2007
JP 2007321387 A 12/2007
JP 2008075303 A 4/2008
JP 2013178896 A 9/2013
JP 2017195039 A 10/2017
JP 2018-079056 A 5/2018
JP 2020161274 A 10/2020
JP 2021050526 A 4/2021
JP 2021-141961 A 9/2021
JP 2021-147889 A 9/2021
JP 2022059770 A 4/2022
JP 2022108351 A 7/2022
(Continued)

*Primary Examiner* — Tuan N Nguyen
(74) *Attorney, Agent, or Firm* — BakerHostetler

(57) ABSTRACT

A wall-mounted flush toilet includes a toilet main body fixed to a wall; and an illuminating device attached to the toilet main body, the illuminating device being configured to emit light to a floor surface, wherein the toilet main body includes a bowl, a discharge trap having an inlet connected below the bowl to discharge waste in the bowl, a skirt configured to cover sides of each of the bowl and the discharge trap, and a rear wall part formed behind the skirt and fixed to the wall, the toilet main body being disposed above a floor surface, and the illuminating device is provided within an internal space provided behind the lowermost end of the discharge trap and above a lower end of the skirt.

16 Claims, 17 Drawing Sheets

(56) References Cited

FOREIGN PATENT DOCUMENTS

| | | | | | |
|---|---|---|---|---|---|
| KR | 102017457 | B1 * | 10/2019 | ..... | E03D 11/02 |
| KR | 20200025414 | A | 3/2020 | | |

* cited by examiner

WALL-MOUNTED FLUSH TOILET

This application claims benefit of priorities to Japanese Patent Application No. 2023-029899, filed on Feb. 28, 2023, Japanese Patent Application No. 2023-029901, filed on Feb. 28, 2023, and Japanese Patent Application No. 2023-029902, filed on Feb. 28, 2023, each entire content of which is incorporated herein by reference.

BACKGROUND OF THE INVENTION

Field of the Invention

The present invention relates to a flush toilet, particularly to a wall-mounted flush toilet fixed to a wall.

Description of the Related Art

Conventionally, as a flush toilet fixed to a wall (so-called "wall-mounted flush toilet"), for example, a flush toilet including a toilet main body provided with an illuminating device is known as described in Patent Literature 1 (Japanese Patent Laid-Open No. 2021-147889).

In such a conventional wall-mounted flush toilet as described in Patent Literature 1, the illuminating device is provided forward of a lower surface of the toilet main body as well as a lowermost end of a discharge trap, and an irradiation range of a light source of the illuminating device extends forward and left and right from the toilet main body in planar view.

In the conventional wall-mounted flush toilet described above, however, there is a problem that a floor surface region directly under the toilet main body and behind the lowermost end of the discharge trap cannot be irradiated, as the illuminating device is provided forward of the lower surface of the toilet main body and the lowermost end of the discharge trap.

The present invention has been made to solve the conventional problems described above, and an object thereof is therefore to provide a wall-mounted flush toilet capable of irradiating a predetermined floor surface region directly under a toilet main body or behind a lowermost end of a discharge trap with light emitted from an illuminating device.

SUMMARY OF THE INVENTION

In order to solve the problems described above, the present invention provides a wall-mounted flush toilet comprising: a toilet main body fixed to a wall and disposed above a floor surface; and an illuminating device attached to the toilet main body, the illuminating device being configured to emit light to the floor surface, wherein the toilet main body includes a bowl configured to receive waste, a discharge trap having an inlet connected below the bowl to discharge waste in the bowl, a skirt configured to cover sides of each of the bowl and the discharge trap, and a rear wall part formed behind the skirt and fixed to the wall, and wherein the discharge trap includes a bent conduit and a descending conduit, the bent conduit being descending to a lowermost end below and behind the inlet and then ascending rearward to a top portion, and the descending conduit being descending rearward from the top portion, and the illuminating device is provided within an internal space provided behind the lowermost end of the discharge trap and above a lower end of the skirt. In the present invention including this configuration, since the illuminating device fixed to the toilet main body and emitting light to the floor surface is provided within the internal space behind the lowermost end of the discharge trap of the toilet main body and above the lower end of the skirt, the illuminating device can be hidden from user's view within the toilet main body, and designability of appearance of the flush toilet can be enhanced. Additionally, when light is emitted toward the floor surface from the illuminating device provided in the internal space disposed above the floor surface, the light is not blocked and is emitted to a predetermined floor surface region directly under the toilet main body and behind the lowermost end of the discharge trap, and this predetermined floor surface region can be made brightest. Furthermore, since the light emitted to the predetermined floor surface region can spread in a gradation pattern from the center of the irradiation region, the appearance of the flush toilet as seen from the user and aesthetics of its surroundings can be enhanced.

In the present invention, preferably, the illuminating device is provided within the internal space behind the ascending bent conduit of the discharge trap and below the descending conduit. In the present invention including this configuration, since the illuminating device is provided within the internal space behind the ascending bent conduit of the discharge trap and below the descending conduit, the illuminating device can clearly emit light from behind the ascending bent conduit of the discharge trap and from below the descending conduit to the predetermined floor surface region directly under the toilet main body. Therefore, gradation of light emitted from the illuminating device to the predetermined floor surface region can be made clear.

In the present invention, preferably, the illuminating device is disposed so that the center of light of a maximum illuminance to be emitted is located in front of the rear wall part. In the present invention including this configuration, the illuminating device is disposed so that the center of the light of the maximum illuminance to be emitted is located in front of the rear wall part of the toilet main body and the gradation of light can be reliably formed for the predetermined floor surface region directly under the toilet main body.

In the present invention, preferably, the illuminating device is disposed so that the emitted light is emitted forward of the lowermost end without overlapping the lowermost end of the discharge trap. In the present invention including this configuration, according to the illuminating device disposed so that the emitted light does not overlap the lowermost end of the discharge trap and is emitted forward of the lowermost end, the emitted light is not blocked by the discharge trap, and the gradation of light can be reliably formed for the predetermined floor surface region directly under the toilet main body.

In the present invention, preferably, the illuminating device is disposed so that the center of light of a maximum illuminance to be emitted is located behind the lowermost end of the discharge trap. In the present invention including this configuration, according to the illuminating device disposed so that center of light of a maximum illuminance to be emitted is located behind the lowermost end of the discharge trap, gradation of light can be formed for the predetermined floor surface region directly under the toilet main body around the center of the toilet main body, thus emphasizing effect that the entire toilet main body appears for the user as if it floats above the floor surface.

In the present invention, preferably, the toilet main body includes a wall surface defining the internal space provided with the illuminating device, and a surface of at least a part of the wall surface is coated with glaze. In the present invention including this configuration, since the surface of at least a part of the wall surface defining the internal space provided with the illuminating device is coated with glaze, part of light emitted from the illuminating device is reflected by the glaze on the wall surface defining the internal space of the toilet main body, and the predetermined floor surface region directly under the toilet main body can be more clearly illuminated with the reflected light together with the light emitted from the illuminating device.

In the present invention, preferably, the illuminating device is fixed to a front of the rear wall part. In the present invention including this configuration, since the illuminating device is fixed to the front of the rear wall part of the toilet main body, the illuminating device can be easily installed in a middle of the toilet main body in a left-right direction, thus facilitating the disposing of the center of the irradiation region with the light within the predetermined floor surface region directly under the toilet main body.

In the present invention, preferably, the illuminating device is fixed with a fastening member from behind the rear wall part. In the present invention including this configuration, the illuminating device is fixed with the fastening member from behind the rear wall part of the toilet main body, and a fixing location or the fastening member behind the rear wall part of the toilet main body where the illuminating device is fixed with the fastening member can be hidden from user's view.

Further, the present invention provides an illuminating device irradiating a floor surface below a toilet, and including a fixing part fixed to the toilet or a cabinet behind the toilet, a light emitter including a light source attached to the fixing part and emitting light, and a translucent cover formed of a translucent material and covering the light emitter, and the translucent cover in a state of being fixed to the toilet or the cabinet with the fixing part is composed of a single member having an exposed surface portion formed integrally without any cut. In the present invention including this configuration, light emitted from the light source of the light emitter transmits through the translucent cover covering the light emitter and is emitted to the floor surface below the toilet, so that a space or the floor surface below the toilet can be brightly illuminated. Since the translucent cover in the state of being fixed to the toilet or the cabinet with the fixing part is composed of the single member having the exposed surface portion formed integrally without any cut, risk of dirt entering the cut in the surface portion of the translucent cover can be eliminated. Furthermore, even if dirt adheres to the surface portion of the translucent cover, the translucent cover composed of the single member formed integrally without any cut can facilitate a wipe-off work of the surface portion, or the like and can enhance cleanability.

In the present invention, preferably, the wall-mounted flush toilet further includes a fixing member configured to fix the light source within the translucent cover, and this fixing member is provided to shield the light source from above so that the light emitted from the light source does not diffuse upward. In the present invention including this configuration, since the fixing member fixing the light source of the light emitter within the translucent cover is provided to shield the light source from above so that the light emitted from the light source does not diffuse upward, the fixing member can inhibit upward diffusion of the light emitted from the light source of the light emitter, reduce generation of unnecessary reflected light or shadow, and reliably diffuse light to the floor surface below the toilet.

In the present invention, preferably, the wall-mounted flush toilet further includes a light shield disposed below the light source, and this light shield includes an opening formed to allow light emitted from the light source to transmit and penetrate the opening. In the present invention including this configuration, the light shield disposed below the light source of the light emitter includes the opening formed to allow the light emitted from the light source to transmit and penetrate the opening. Consequently, brightness of light passing through the opening can be adjusted, and directivity of light can be enhanced by passing light through the opening of the light shield, when light emitted from the light source of the light emitter passes through the opening of the light shield and is emitted to the floor surface below the toilet.

In the present invention, preferably, the wall-mounted flush toilet further includes an auxiliary light shielding member provided between the fixing member and the translucent cover. In the present invention including this configuration, the auxiliary light shielding member provided between the fixing member and the translucent cover can eliminate a gap between the fixing member and the translucent cover. Therefore, light emitted from the light source of the light emitter can be inhibited from being emitted to the floor surface below the toilet from a portion other than the opening of the light shield.

In the present invention, preferably, the translucent cover has an irradiation surface formed almost flat. In the present invention including this configuration, the irradiation surface of the translucent cover is formed almost flat, so that a spot of light focused on a specific region on the floor surface can be effectively formed, when the light emitted from the light source of the light-emitter is transmitted through the irradiation surface of the translucent cover and is emitted to the floor surface below the toilet.

The present invention also provides a wall-mounted flush toilet provided with the above illuminating device. In the present invention including this configuration, it is possible to provide a wall-mounted flush toilet including an illuminating device capable of brightly illuminating a space or floor surface below the toilet and enhancing cleanability.

Furthermore, the present invention provides an illuminating device configured to irradiate a floor surface below a flush toilet within a toilet room, the illuminating device includes an illuminating device main body provided within the flush toilet or within a cabinet or wall surface behind the flush toilet, the flush toilet includes a toilet main body including a bowl that receives waste, and a discharge trap having an inlet connected below the bowl to discharge waste in the bowl, and the illuminating device main body is disposed behind a front end of the toilet main body and is configured to block light emitted from the illuminating device main body by a part of the toilet main body and to form a shadow for guiding a user to the floor surface. In the present invention including this configuration, since the illuminating device main body provided within the flush toilet or within the cabinet or wall surface behind the flush toilet is disposed behind the front end of the toilet main body, the light emitted from the illuminating device main body is blocked by a part of the toilet main body, and the shadow for guiding the user to the floor surface below the flush toilet within the toilet room can be formed. Even if it is dark within the toilet room, the user can be reliably guided to a proper fixed position on the floor surface below the flush toilet within the toilet room. Therefore, for example, when the user (male) urinates toward an interior of the bowl of the toilet main body of the flush toilet, guiding by the shadow can properly keep a distance between the user and the toilet main body, and urine bounce and splash from the toilet main body can be suppressed.

In the present invention, preferably, the illuminating device main body is disposed below and behind the toilet main body and is further configured to form a shadow for guiding the user to the floor surface in front of the toilet main body. In the present invention including this configuration, since the illuminating device main body provided within the flush toilet or within the cabinet or wall surface behind the flush toilet is disposed below and behind the toilet main body, the light emitted from the illuminating device main body can form the shadow for guiding the user to the floor surface in front of the toilet main body of the flush toilet. Even if it is dark within the toilet room, the user can grasp user's standing position and a relative distance between this standing position and the toilet main body by visually checking the shadow on the floor surface in front of the toilet main body. The user can be guided more reliably to the proper fixed position on the floor surface in front of the toilet main body of the flush toilet within the toilet room without directly looking at bright light. Therefore, for example, when guided by the shadow to the proper fixed position on the floor surface in front of the toilet main body to urinate toward the interior of the bowl of the toilet main body, the user can properly keep the distance between the user and the toilet main body, and urine bounce and splash from the toilet main body can be suppressed.

In the present invention, preferably, the illuminating device main body is disposed in a central portion of the toilet main body in a left-right width direction and is configured to form a shadow that expands a width in a left-right direction as being away from the toilet main body. In the present invention including this configuration, the illuminating device main body is disposed in the central portion of the toilet main body of the flush toilet in the left-right width direction and can form the shadow that expands the width in the left-right direction as being away from the toilet main body. Consequently, for example, when the user urinates toward the interior of the bowl of the toilet main body, the user can easily grasp the central portion of the toilet main body in the left-right width direction, and the user can be easily guided to the proper fixed position near the center of the toilet main body in the left-right width direction in the floor surface in front of the toilet main body of the flush toilet within the toilet room. To urinate toward the interior of the bowl of the toilet main body, the user can properly keep the distance between the user and the toilet main body, and a central position of the toilet main body in the left-right width direction. Therefore, urine scattering to the toilet main body can be suppressed, and urine bounce and splash of urine from the toilet main body can be suppressed.

In the present invention, preferably, the discharge trap further forms a bent conduit descending to a lowermost end below and behind the inlet and then ascending rearward to a top portion, and the illuminating device main body is disposed behind the lowermost end of the discharge trap and configured so that light emitted from the illuminating device main body is blocked by the discharge trap to form a shadow. In the present invention including this configuration, since the illuminating device main body is disposed behind the lowermost end of the discharge trap of the toilet main body, the light emitted from the illuminating device main body is blocked by the discharge trap of the toilet main body, and the shadow for guiding the user to the floor surface in front of the toilet main body of the flush toilet can be reliably formed. Consequently, for example, when guided by the shadow to the proper fixed position on the floor surface in front of the toilet main body to urinate toward the interior of the bowl of the toilet main body, the user can properly keep the distance between the user and the toilet main body, so that urine bounce and splash from the toilet main body can be suppressed.

In the present invention, preferably, the wall-mounted flush toilet further includes a human body detection sensor that detects a position of the user and a controller that controls the illuminating device main body, and the controller changes the light emitted from the illuminating device main body based on a signal obtained from the human body detection sensor. In the present invention including this configuration, the controller that controls the illuminating device main body can change the light emitted from the illuminating device main body (for example, illuminance of light, flashing of light, color of light, and the like) based on the signal obtained from the human body detection sensor that detects the position of the user. The light from the illuminating device main body changed by the controller can form the shadow for guiding the user to the floor surface below the flush toilet within the toilet room. Even if it is dark within the toilet room, the user can see an outline of shadow projected on the floor surface below the flush toilet and can grasp whether the user is at a proper fixed position on the floor surface below the flush toilet, and the user can be reliably guided to the fixed position on the floor surface below the flush toilet within the toilet room. Therefore, for example, when guided by the shadow to urinate toward the interior of the bowl of the toilet main body, the user can properly keep the distance between the user and the toilet main body, and the urine bounce and splash from the toilet main body can be suppressed.

Further, the present invention provides a wall-mounted flush toilet including the illuminating device. The present invention including this configuration provides the wall-mounted flush toilet including the illuminating device capable of reliably guiding the user to the proper fixed position on the floor surface below the flush toilet within the toilet room when the user urinates toward the interior of the bowl of the toilet main body and capable of suppressing urine bounce and splash from the toilet main body.

The present invention provides a cabinet including the illuminating device and being provided behind the flush toilet. The present invention including this configuration can provide the cabinet provided behind the flush toilet and including the illuminating device capable of reliably guiding the user to the proper fixed position on the floor surface below the flush toilet within the toilet room when the user urinates toward the interior of the bowl of the toilet main body and capable of suppressing urine bounce and splash from the toilet main body.

According to the wall-mounted flush toilet of the present invention, light emitted from the illuminating device can be emitted to the predetermined floor surface region directly under the toilet main body and behind the lowermost end of the discharge trap.

DETAILED DESCRIPTION OF THE PREFERRED EMBODIMENTS

Figure 1:
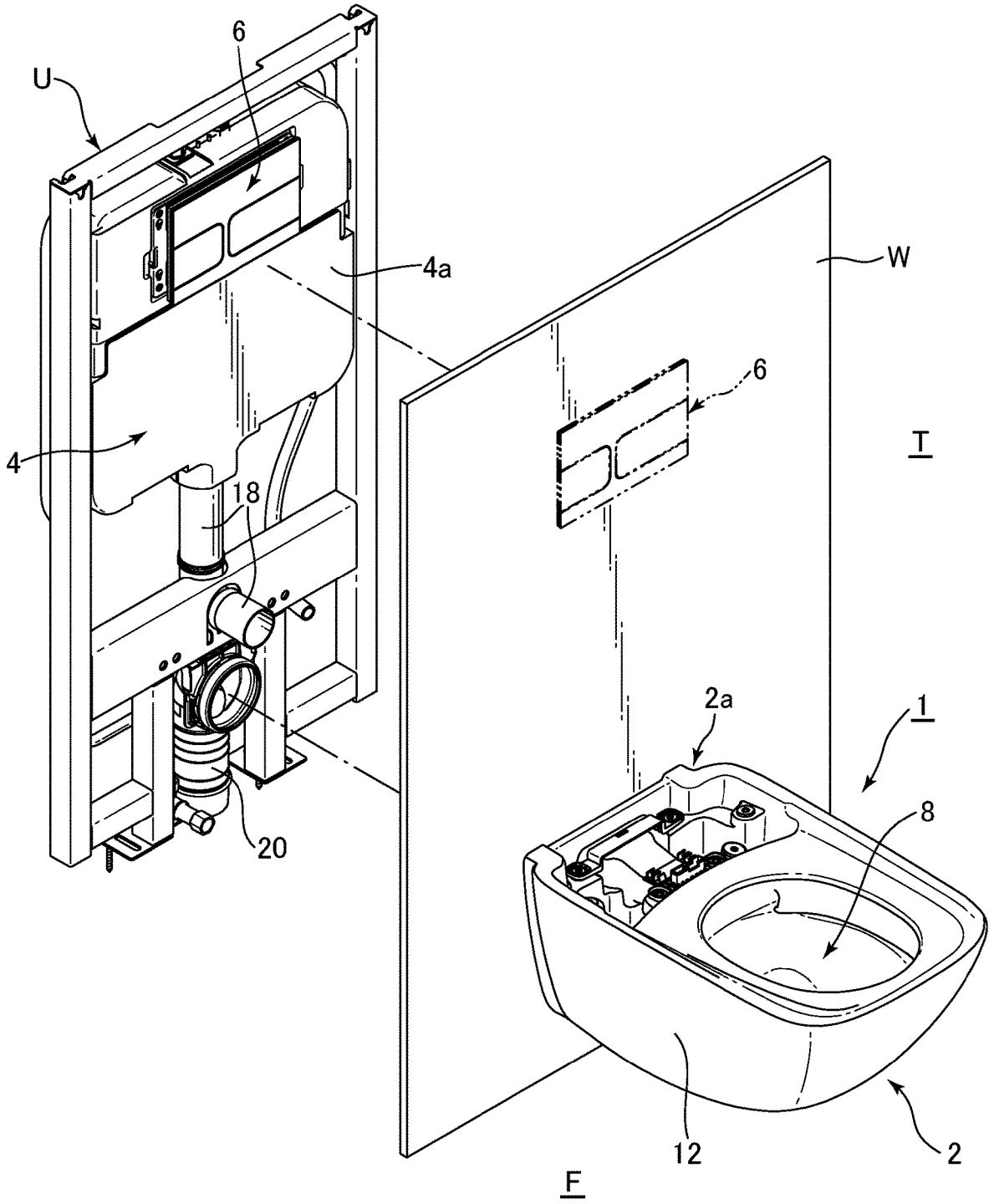
FIG. 1 is an exploded perspective view showing a state where a wall-mounted flush toilet according to a first embodiment of the present invention is fixed to a wall.
Figure 2:
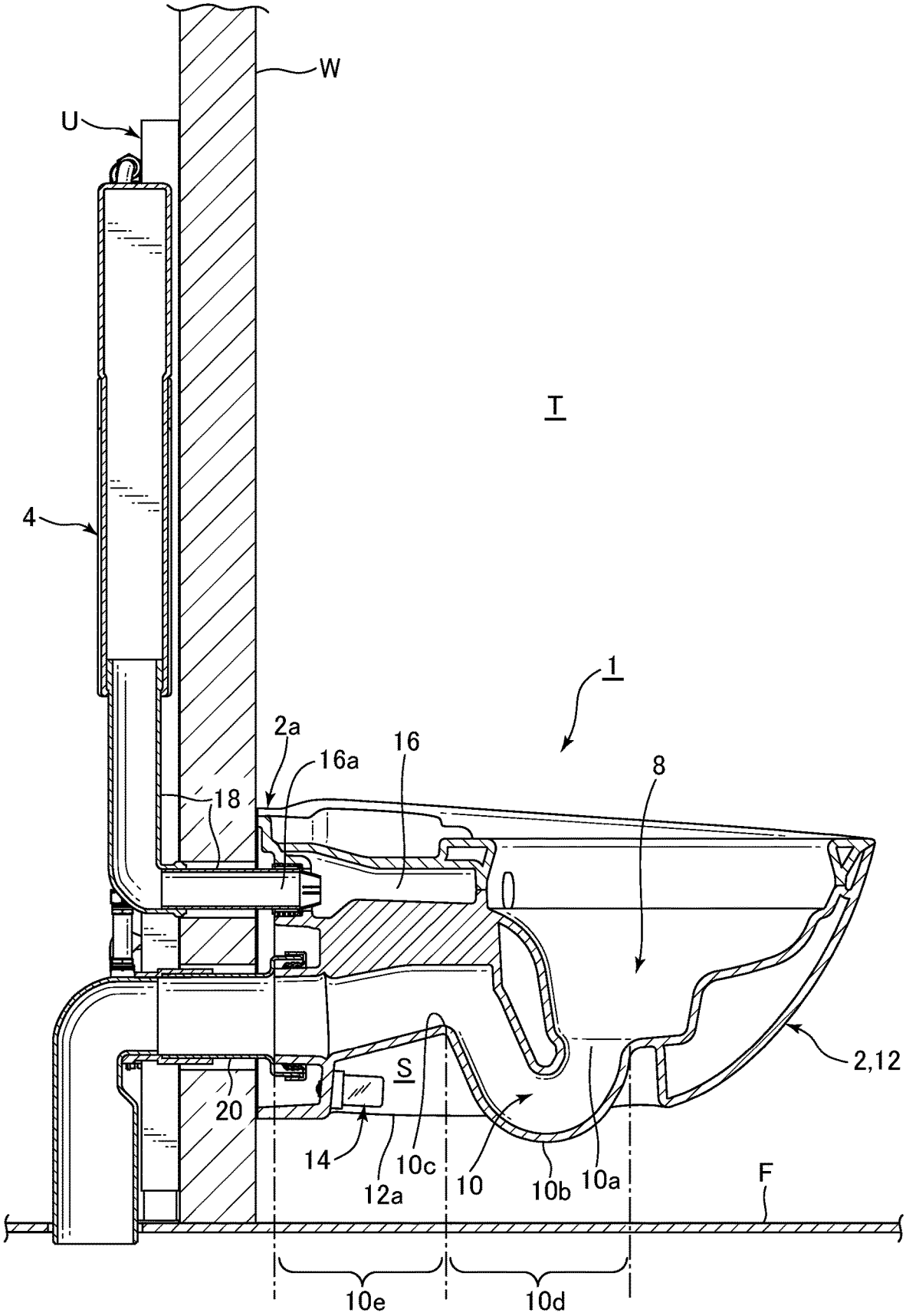
FIG. 2 is a central side cross-sectional view showing the state where the wall-mounted flush toilet according to the first embodiment of the present invention is fixed to the wall.

Hereinafter, with reference to FIGS. 1 to 10, a wall-mounted flush toilet according to a first embodiment of the present invention will be described. First, as shown in FIGS. 1 and 2, a wall-mounted flush toilet 1 according to the first embodiment of the present invention includes a toilet main body 2 having a rear end part (rear wall part 2*a*) fixed to a wall W, on the rear in a toilet room T, and the toilet main body 2 has a lower end disposed above a floor surface F. As shown in FIG. 1, the wall-mounted flush toilet 1 of the present embodiment more specifically includes a structure where the toilet main body 2 is fixed from the back of the wall with a fixing unit U provided on the rear of the wall W (back of the wall). Further, on a fixed unit U side, a flush water supply device 4 that is a water supply source supplying flush water to the toilet main body 2 of the flush toilet 1, a flushing operation device 6 operating the flush water supply device 4, and the like are provided, and these devices 4 and 6 are hidden on the back of the wall W. In the flush toilet 1 of the present embodiment, as the flush water supply device 4 that is the water supply source supplying flush water to the toilet main body 2, a form employing a so-called "gravity water supply type" of reservoir tank 4*a* supplying flush water reserved in the reservoir tank 4*a* to the toilet main body 2 by gravity is described, but as another form of water supply source, a so-called "tap water direct pressure type" of water supply device that directly supplies flush water to the toilet main body 2 by use of water supply pressure from water service may be employed. Additionally, a "flush valve type" of water supply device, a "pump type" of water supply device that supplies flush water reserved in the reservoir tank by use of auxiliary pressure of a pump, or the like may be employed.

Next, as shown in FIGS. 1 and 2, the toilet main body 2 of the flush toilet 1 of the present embodiment is a ceramic toilet main body 2 formed of ceramic. This ceramic toilet main body 2 includes a bowl 8 that receives waste, and a discharge trap 10 having an inlet 10*a* connected below the bowl 8 to discharge waste in the bowl 8. The ceramic toilet main body 2 includes a skirt 12 that covers, from sides, an outer shell of each of the bowl 8 and the discharge trap 10, and the rear end part (rear wall part 2*a*) formed behind the skirt 12 and fixed to the wall W. As shown in FIG. 2, the discharge trap 10 of the toilet main body 2 forms a bent conduit 10*d* descending to a lowermost end 10*b* below and behind the inlet 10*a* and then ascending rearward to a top portion 10*c* and forms a descending conduit 10*e* descending rearward from the top portion 10*c* of the bent conduit 10*d*.

Figure 3:
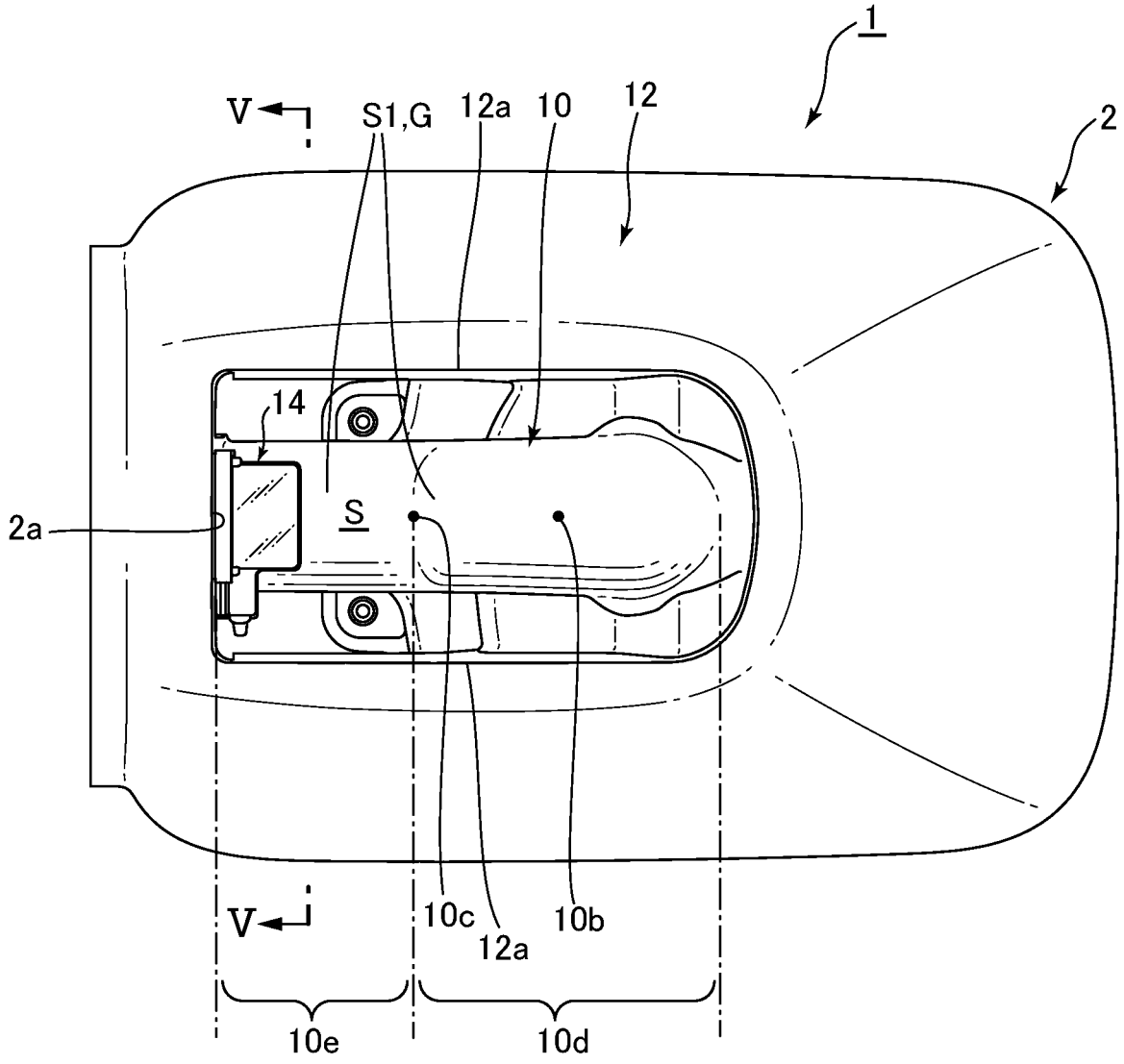
FIG. 3 is a bottom view of the wall-mounted flush toilet according to the first embodiment of the present invention.

As shown in FIGS. 2 and 3, an illuminating device 14, described later in detail, is provided within an internal space S of the toilet main body 2 behind the lowermost end 10*b* of the discharge trap 10 and above a lower end 12*a* of the skirt 12. The illuminating device 14 is fixed to the rear wall part 2*a* of the toilet main body 2 and can emit light to the floor surface F below the toilet main body 2.

As shown in FIGS. 1, 2, 4 and 5, in the toilet main body 2 in a state of the ceramic toilet main body 2 fixed to the wall W with the fixing unit U, an inlet 16*a* that is an upstream end (rear end) of a main water conduit 16 formed upstream of the bowl 8 is connected to a water supply pipe 18 extending downstream from the reservoir tank 4*a* of the flush water supply device 4. In the toilet main body 2 in the state of the ceramic toilet main body 2 fixed to the wall W with the fixing unit U, an exit 10*f* that is a downstream end (rear end) of the discharge trap 10 is connected to a discharge pipe 20 extending upward from the floor surface F on the back of the wall W and then bending and extending forward. The wall-mounted flush toilet 1 of the present embodiment may be in the form of a so-called "wash-away type" of flush toilet that washes away waste in the bowl 8 by use of water drop in a height direction of the bowl 8 within the toilet main body 2, a so-called "siphon type" of flush toilet that takes in waste in the bowl 8 by use of siphon action to discharge the waste outward from the discharge trap 10, or another type of flush toilet.

Figure 7:
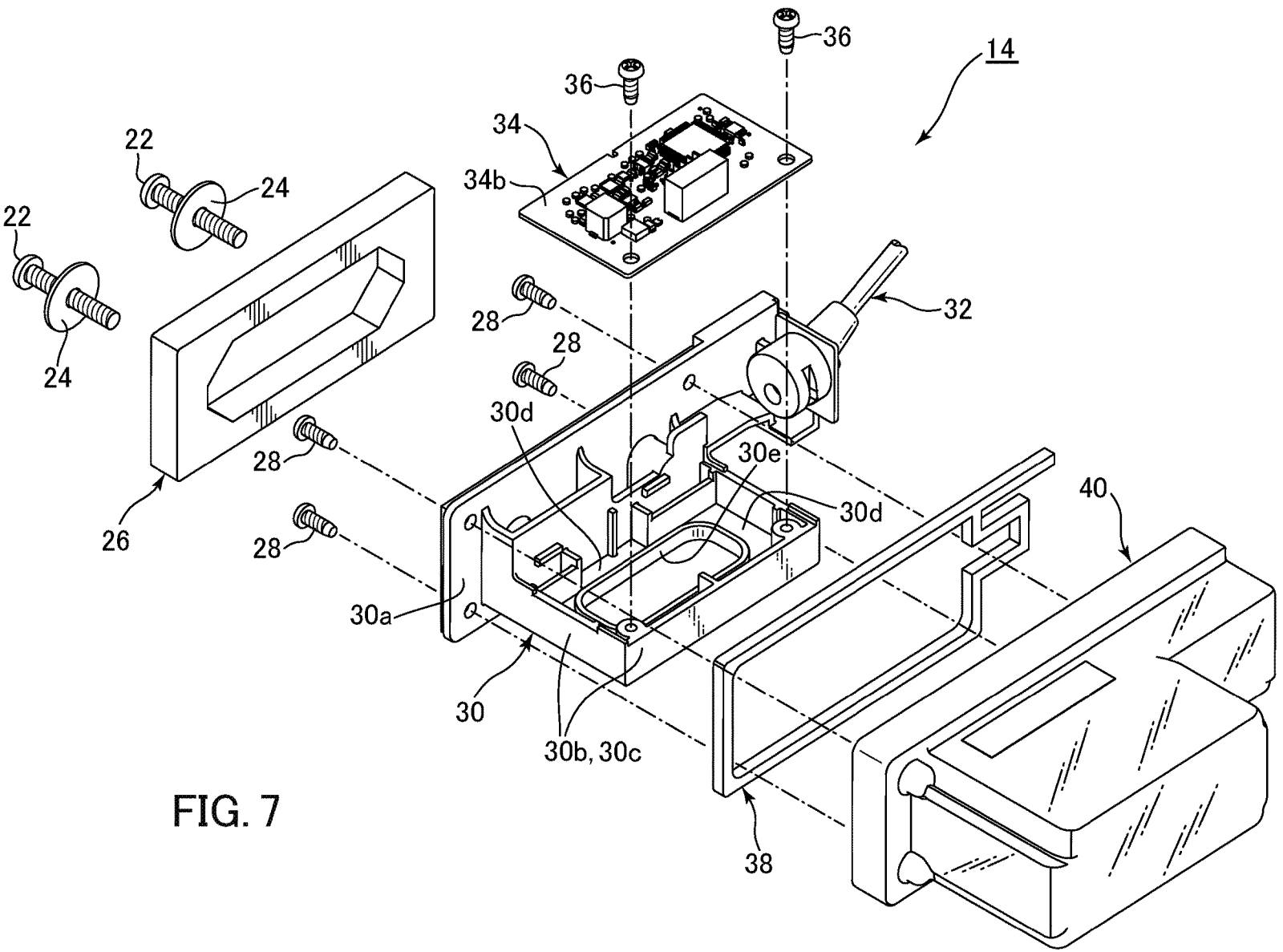
FIG. 7 is an exploded perspective view of the illuminating device for the wall-mounted flush toilet according to the first embodiment of the present invention.
Figure 8:
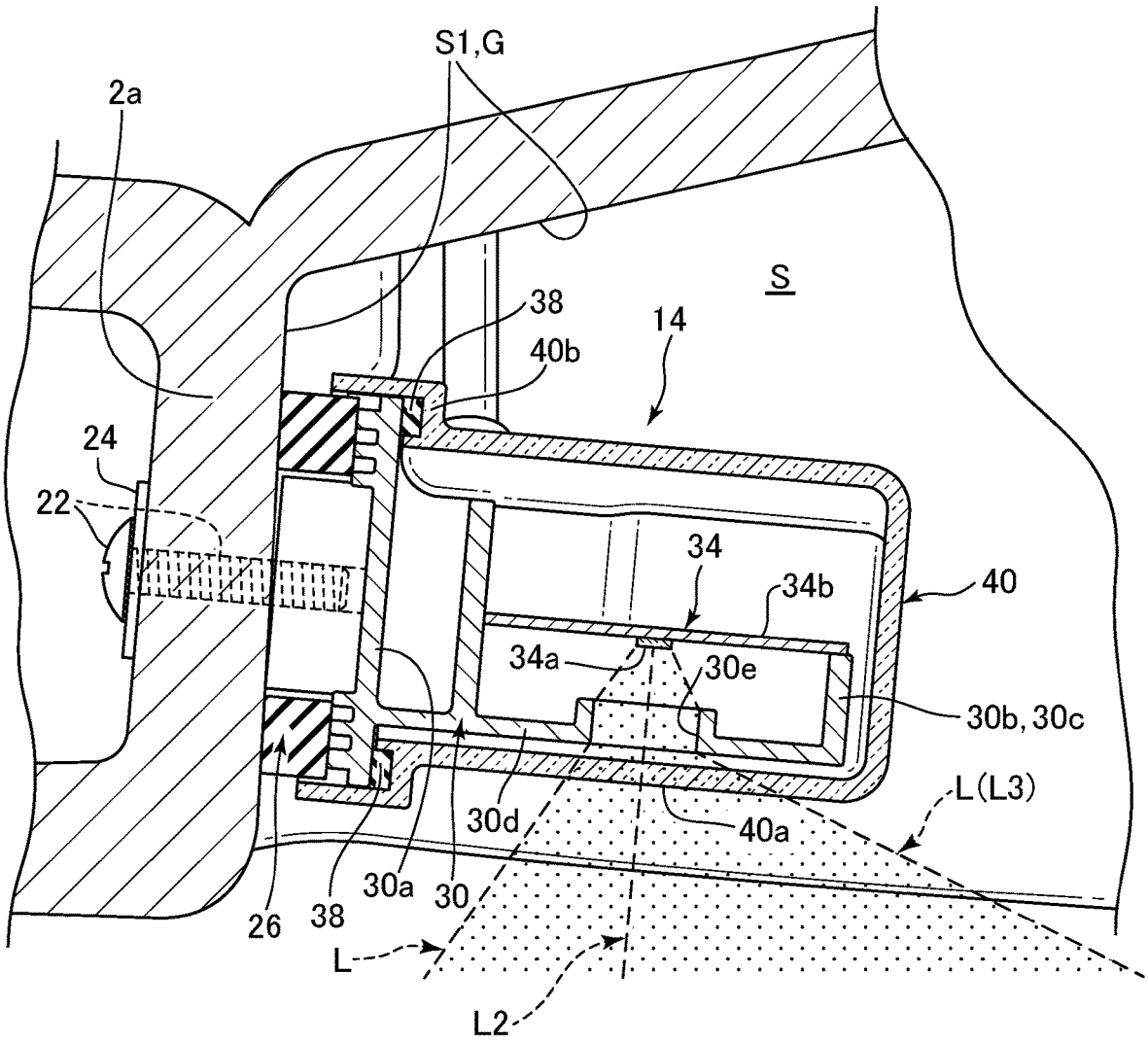
FIG. 8 is a central side cross-sectional view of the illuminating device attached to a toilet main body of the wall-mounted flush toilet according to the first embodiment of the present invention.
Figure 9:
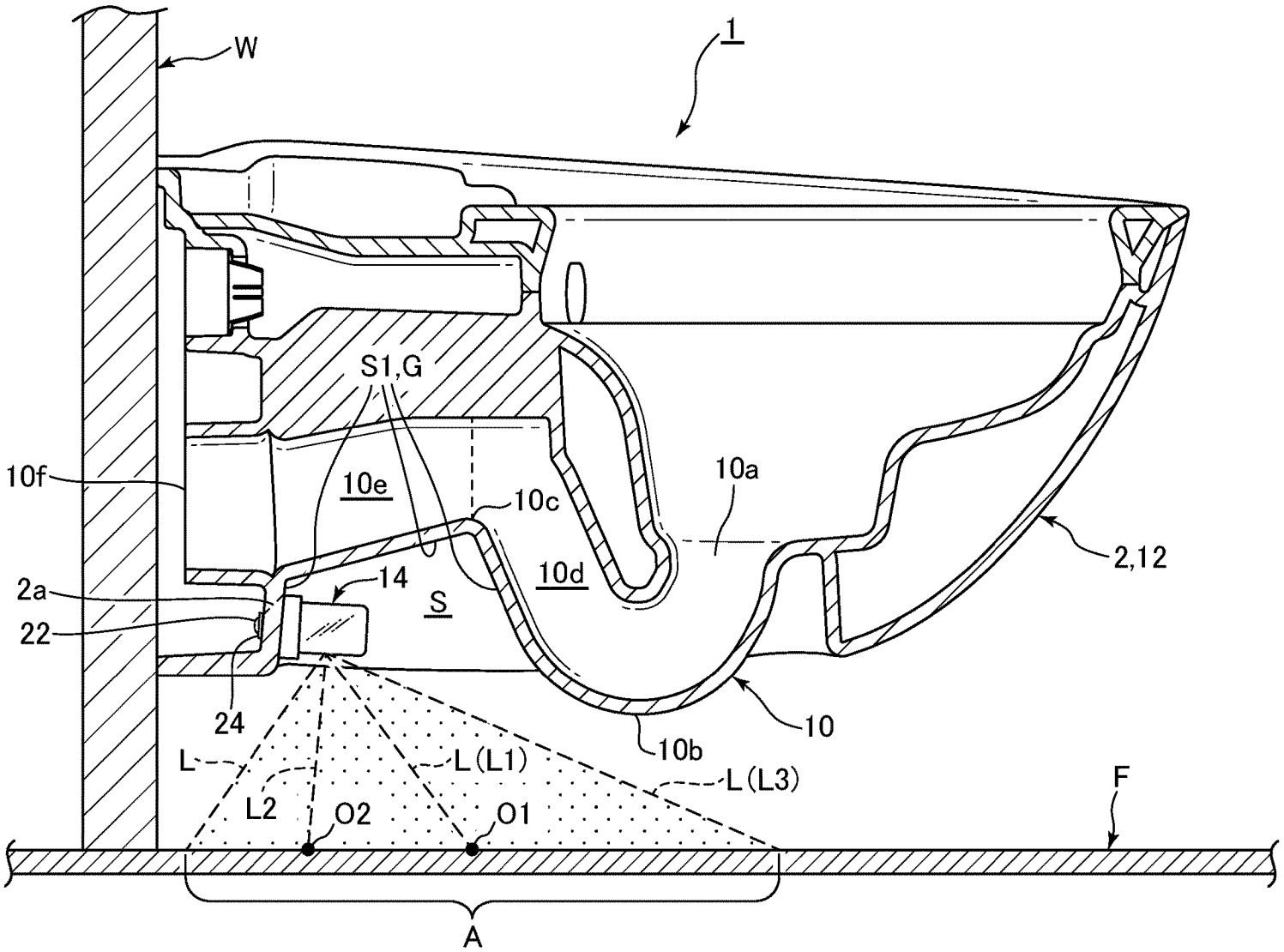
FIG. 9 is a schematic central side cross-sectional view of the wall-mounted flush toilet according to the first embodiment of the present invention, and shows a state where the illuminating device emits light to a floor surface.

With reference to FIGS. 2 to 9, details of the illuminating device 14 of the wall-mounted flush toilet 1 according to the present embodiment will be described. First, as shown in FIGS. 2, 3, 5, 6, 8 and 9, the illuminating device 14 is provided within the internal space S of the toilet main body 2 below the descending conduit 10*e* of the discharge trap 10 of the toilet main body 2. In FIG. 9, a predetermined floor surface region irradiated with entire light L emitted from the illuminating device 14 is defined as "irradiation region A". The irradiation region A has an approximately circular outer shape in planar view and forms a diffusion range A of the light L emitted on the floor surface F. Further, light emitted to a center O1 of the irradiation region A (diffusion range A) is defined as "light L1 of the center O1 of the diffusion range A". Additionally, in the entire light L emitted from the illuminating device 14 shown in FIG. 9 to the irradiation region A (diffusion range A) of the floor surface F, light L having a maximum illuminance is defined as "light L2 of the maximum illuminance", and a point O2 within the irradiation region A irradiated with the light L2 of the maximum illuminance is defined as "center O2 of the light L". As shown in FIG. 9, the illuminating device 14 is disposed so that the center O2 of the light L2 of the maximum illuminance to be emitted is located in front of the rear wall part 2*a* of the toilet main body 2. Further, as shown in FIG. 9, the illuminating device 14 is disposed so that light L3 emitted forwardmost is emitted forward of the lowermost end 10*b* without overlapping the lowermost end 10*b* of the discharge trap 10 of the toilet main body 2. Additionally, as shown in FIG. 9, the illuminating device 14 is disposed so that the center O2 of the light L2 of the maximum illuminance to be emitted is located behind the lowermost end 10*b* of the discharge trap 10 of the toilet main body 2. As shown in FIGS. 3, 5, 6, 8, and 9, a wall surface S1 is disposed to define the internal space S of the toilet main body 2 provided with the illuminating device 14, and a surface of at least a part of the wall surface S1 is coated with glaze G.

As shown in FIGS. 3 to 9, the illuminating device 14 is fixed to the front of the rear wall part 2*a* of the toilet main body 2, as will be described later in detail with respect to configuration and internal structure of each part. To fix the illuminating device 14 to the rear wall part 2*a* of the toilet main body 2, the device is fixed with a pair of fastening members (tapping screws 22, 22, washers 24, 24) from behind the rear wall part 2*a*.

Figure 5:
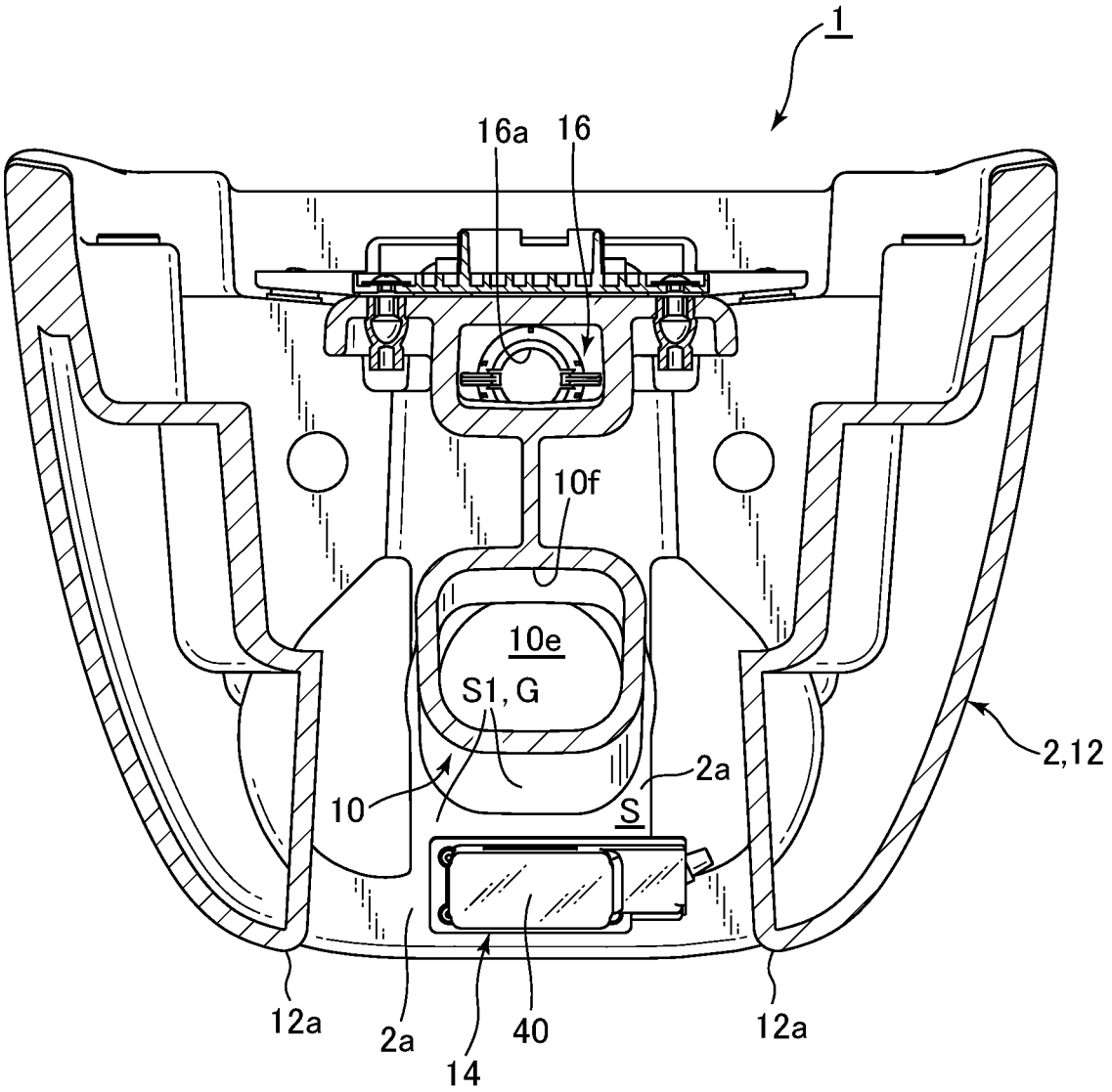
FIG. 5 is a cross-sectional view along the V-V line of FIG. 3.
Figure 6:
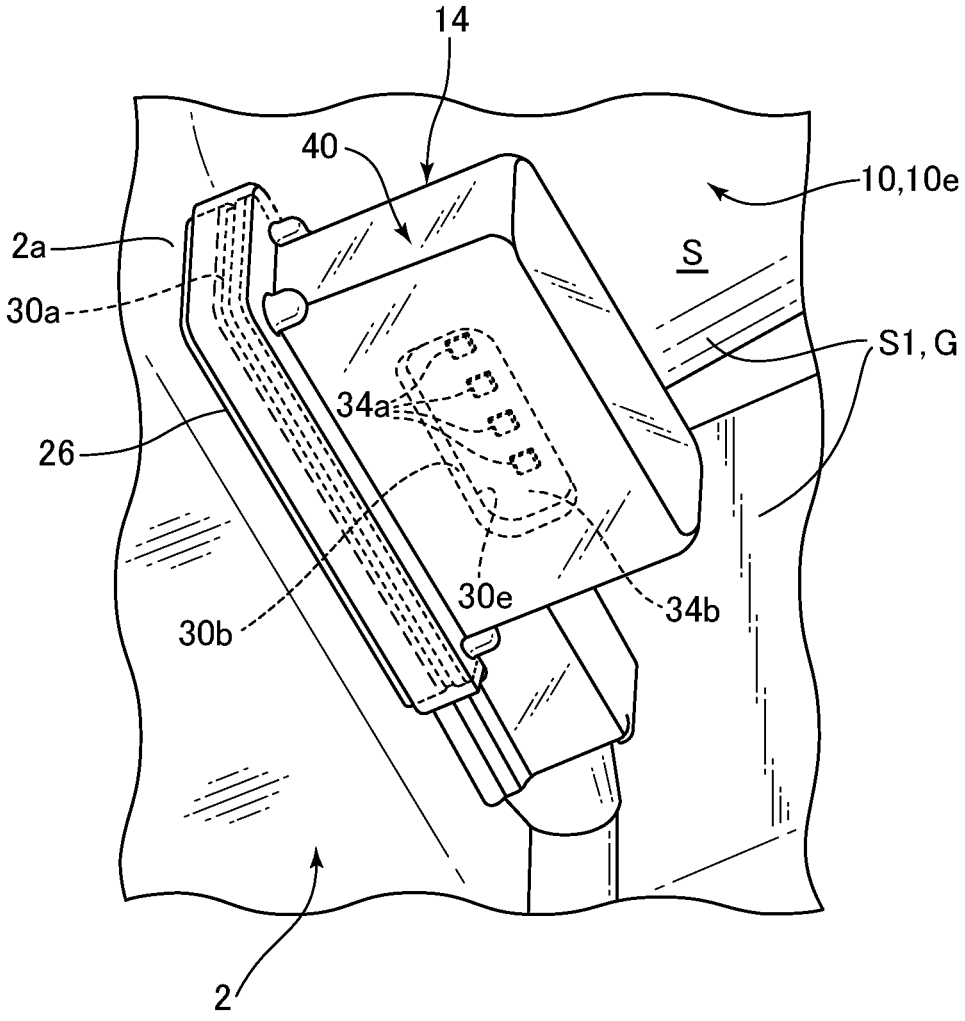
FIG. 6 is a perspective view of an illuminating device for the wall-mounted flush toilet according to the first embodiment of the present invention as viewed obliquely from below.

Next, with reference to FIGS. 5 to 8, details such as the configuration and internal structure of each part of the illuminating device 14 will be described. First, as shown in FIGS. 6 to 8, the configuration of the illuminating device 14 includes, from the rear toward the front, a pair of tapping screws 22, 22, a pair of washers 24, 24, a ceramic-side waterproof packing 26, a plurality of (four) body fixing screws 28, 28, 28, 28, a housing 30, a power supply harness 32, an LED board 34, a plurality of (two) board fixing screws 36, 36, a body-side waterproof packing 38, and a translucent cover 40. The housing 30 is entirely made of a light-shielding material (a material hard to pass light), and a fixing part 30*a* provided rearward of the housing is fixed from behind with the pair of fastening members (tapping screws 22, 22, washers 24, 24). Consequently, the fixing part 30*a* of the housing 30 on the rear is fixed to the front of the rear wall part 2*a* of the toilet main body 2 via the ceramic-side waterproof packing 26. The housing 30 includes a support receiver 30*b* protruding forward from a rear end part. The support receiver 30*b* is defined by a sidewall 30*c* generally formed in a rectangular shape to surround an internal space in planar view. The LED board 34 is attached to an upper end of the sidewall 30*c* in the support receiver 30*b* of the housing 30. The LED board 34 is fixed to the support receiver 30*b* with the plurality of (two) board fixing screws 36 and 36. The LED board 34 is a light emitter including a plurality of (four) light sources (LED elements 34*a*, 34*a*, 34*a*, 34*a*) arranged in a left-right direction on a lower surface of the board. The power supply harness 32 is electrically connected to a part of the LED board 34 at one end side and is electrically connected to a power supply cable (not shown) supplying power to a functional part (not shown) of the flush toilet 1 via a connector (not shown) at the other end.

Next, as shown in FIGS. 5 to 8, the translucent cover 40 is formed of a translucent material and is attached to cover the support receiver 30*b* of the housing 30 and the LED board 34 from top, bottom, left, right, and front. The translucent cover 40 on the rear is fixed to a front surface of the fixing part 30*a* of the housing 30 via the body-side waterproof packing 38 with the plurality of (four) body fixing screws 28, 28, 28, and 28 attached from behind the fixing part 30*a* of the housing 30. The translucent cover 40 is composed of a single member having an exposed surface portion formed integrally without any cut. The translucent cover 40 further has a surface 40*a* (lower surface 40*a*) formed almost flat on an irradiation side of the translucent cover.

Further, as shown in FIGS. 6 to 8, the LED board 34 includes a thin plate-like board member 34*b* including a plurality of (four) light sources (LED elements 34*a*, 34*a*, 34*a*, 34*a*) arranged in the left-right direction on a lower surface of the board. The board member 34*b* functions as a fixing member fixing the plurality of (four) light sources (LED elements 34*a*, 34*a*, 34*a*, 34*a*) within the translucent cover 40, and as a shielding member shielding the respective light sources 34*a*, 34*a*, 34*a*, 34*a* from above so that the light L emitted from the respective light sources 34*a*, 34*a*, 34*a*, 34*a* does not diffuse upward. More specifically, since the housing 30 itself is opened upward, the board member 34*b* itself in the LED board 34 blocks light upward, and the housing 30 itself, made of the material hard to pass light, blocks light circling around the LED board 34 and leaking upward.

The housing 30 includes a light shield 30*d* provided at a lower end of the support receiver 30*b*. In the light shield 30*d*, an opening 30*e* provided below the respective light sources 34*a*, 34*a*, 34*a*, 34*a* is formed so that the light L emitted from the respective light sources 34*a*, 34*a*, 34*a*, 34*a* is allowed to transmit and penetrate the light shield 30*d* in an up-down direction.

The housing 30 also functions as a fixing member fixing the LED board 34 (respective light sources 34*a*, 34*a*, 34*a*, 34*a*) to an interior of the translucent cover 40. The body-side waterproof packing 38 makes a gap watertight between a front surface of the fixing part 30*a* of the housing 30, which is such a fixing member, and a rear stepped part (rear stepped part 40*b*) in the translucent cover 40 facing the front surface in a front-rear direction, and the packing also functions as an auxiliary light shielding member that assists in light shielding so that the light L emitted from the respective light sources 34*a*, 34*a*, 34*a*, 34*a* is prevented from illuminating the gap between the front surface of the fixing part 30*a* of the housing 30 and the rear stepped part 40*b* in the translucent cover 40.

Next, with reference to FIGS. 1 to 10, an operation of the wall-mounted flush toilet 1 according to the first embodiment of the present invention will be described. According to the wall-mounted flush toilet 1 of the present embodiment described above, the illuminating device 14 fixed to the toilet main body 2 and emitting the light L to the floor surface F is provided within the internal space S provided behind the lowermost end 10*b* of the discharge trap 10 of the toilet main body 2 and above the lower end 12*a* of the skirt 12. Consequently, since the illuminating device 14 can be hidden from user's view within the toilet main body 2, designability of appearance of the flush toilet 1 can be enhanced. Additionally, when the light L is emitted toward the floor surface F from the illuminating device 14 provided in the internal space S of the toilet main body 2 disposed above the floor surface F, the light L is not blocked and is emitted to the predetermined floor surface region A directly under the toilet main body 2 and behind the lowermost end 10*b* of the discharge trap 10, and the predetermined floor surface region A can be made brightest. Furthermore, since the light L emitted to the predetermined floor surface region A can spread in a gradation pattern from the center O2 of the light L2 of the maximum illuminance in this irradiation region A, the appearance of the flush toilet 1 as viewed by the user and aesthetics of its surroundings can be enhanced.

According to the wall-mounted flush toilet 1 of the present embodiment, the illuminating device 14 is provided within the internal space S behind the ascending bent conduit 10*d* of the discharge trap 10 of the toilet main body 2 and below the descending conduit 10*e*. The illuminating device 14 can clearly emit light from below the descending conduit 10*e* of the discharge trap 10 of the toilet main body 2 to the predetermined floor surface region A directly under the toilet main body 2. Therefore, gradation LG of the light L emitted from the illuminating device 14 to the predetermined floor surface region A can be made clear.

According to the wall-mounted flush toilet 1 of the present embodiment, the illuminating device 14 is disposed so that the center O2 of the light L2 of the maximum illuminance to be emitted is located in front of the rear wall part 2*a* of the toilet main body 2. Consequently, the gradation LG of the light L can be reliably formed for the predetermined floor surface region A directly under the toilet main body 2.

According to the wall-mounted flush toilet 1 of the present embodiment, the illuminating device 14 is disposed so that the light emitted forwardmost is emitted forward of the lowermost end 10*b* without overlapping the lowermost end 10*b* of the discharge trap 10 of the toilet main body 2. Consequently, the emitted light L is not blocked by the discharge trap 10 of the toilet main body 2, and the gradation LG of the light L can be reliably formed for the predetermined floor surface region A directly under the toilet main body 2.

Figure 10:
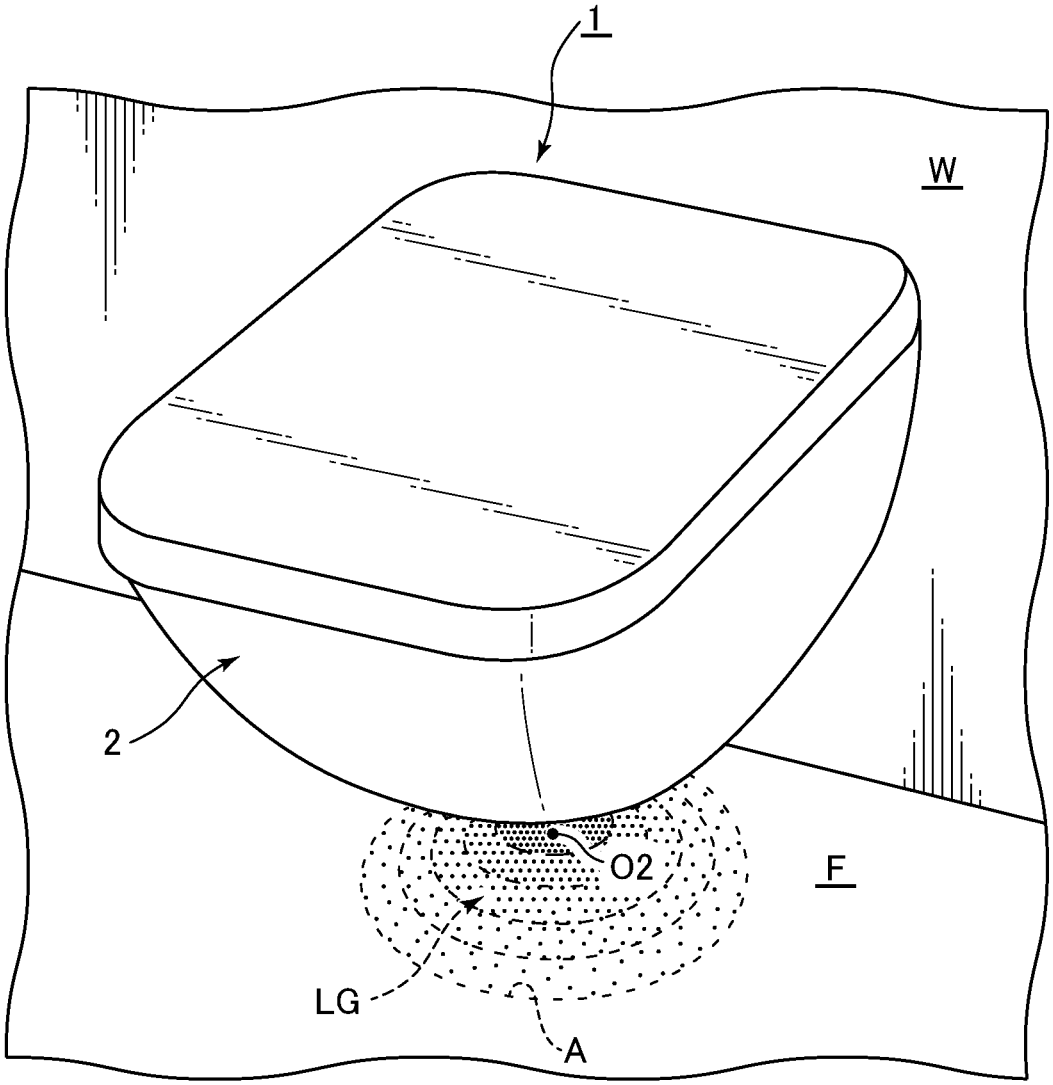
FIG. 10 is a schematic perspective view of the wall-mounted flush toilet according to the first embodiment of the present invention and shows a state where the illuminating device emits light to the floor surface.
Figure 11:
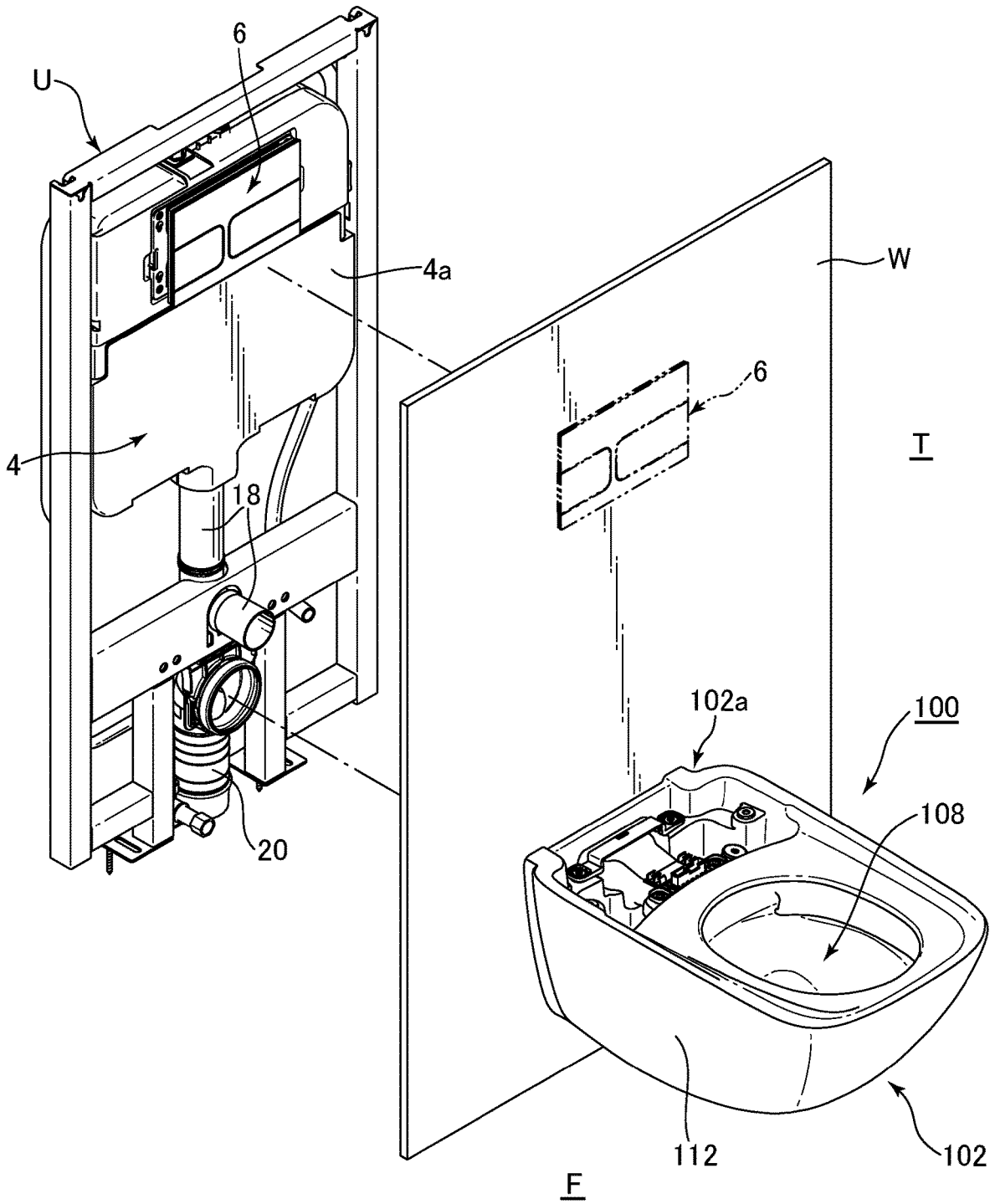
FIG. 11 is an exploded perspective view showing a state where a wall-mounted flush toilet according to a second embodiment of the present invention is fixed to a wall.

According to the wall-mounted flush toilet 1 of the present embodiment, the illuminating device 14 is disposed so that the center O2 of the light L2 of the maximum illuminance to be emitted is located behind the lowermost end 10*b* of the discharge trap 10 of the toilet main body 2. Consequently, as shown in FIG. 10, the gradation LG of the light L can be formed for the predetermined floor surface region A directly under the toilet main body 2 around the center of the toilet main body 2, thus emphasizing effect that the entire toilet main body 2 appears for the user as if it floats above the floor surface F.

According to the wall-mounted flush toilet 1 of the present embodiment, the surface of at least a part of the wall surface S1 defining the internal space S of the toilet main body 2 provided with the illuminating device 14 is coated with the glaze G. Consequently, part of the light L emitted from the illuminating device 14 is reflected by the glaze G on the wall surface S1 defining the internal space S of the toilet main body 2, so that the predetermined floor surface region A directly under the toilet main body 2 can be more clearly illuminated with the reflected light together with the light L emitted from the illuminating device 14.

According to the wall-mounted flush toilet 1 of the present embodiment, the illuminating device 14 is fixed to the front of the rear wall part 2*a* of the toilet main body 2. Consequently, as shown in FIGS. 3 and 5, the illuminating device 14 can be easily installed in the middle of the toilet main body 2 in the left-right direction, thus facilitating the disposing of the center O2 of the light L2 in the irradiation region A with the light L within the predetermined irradiation region A directly under the toilet main body 2.

Figure 4:
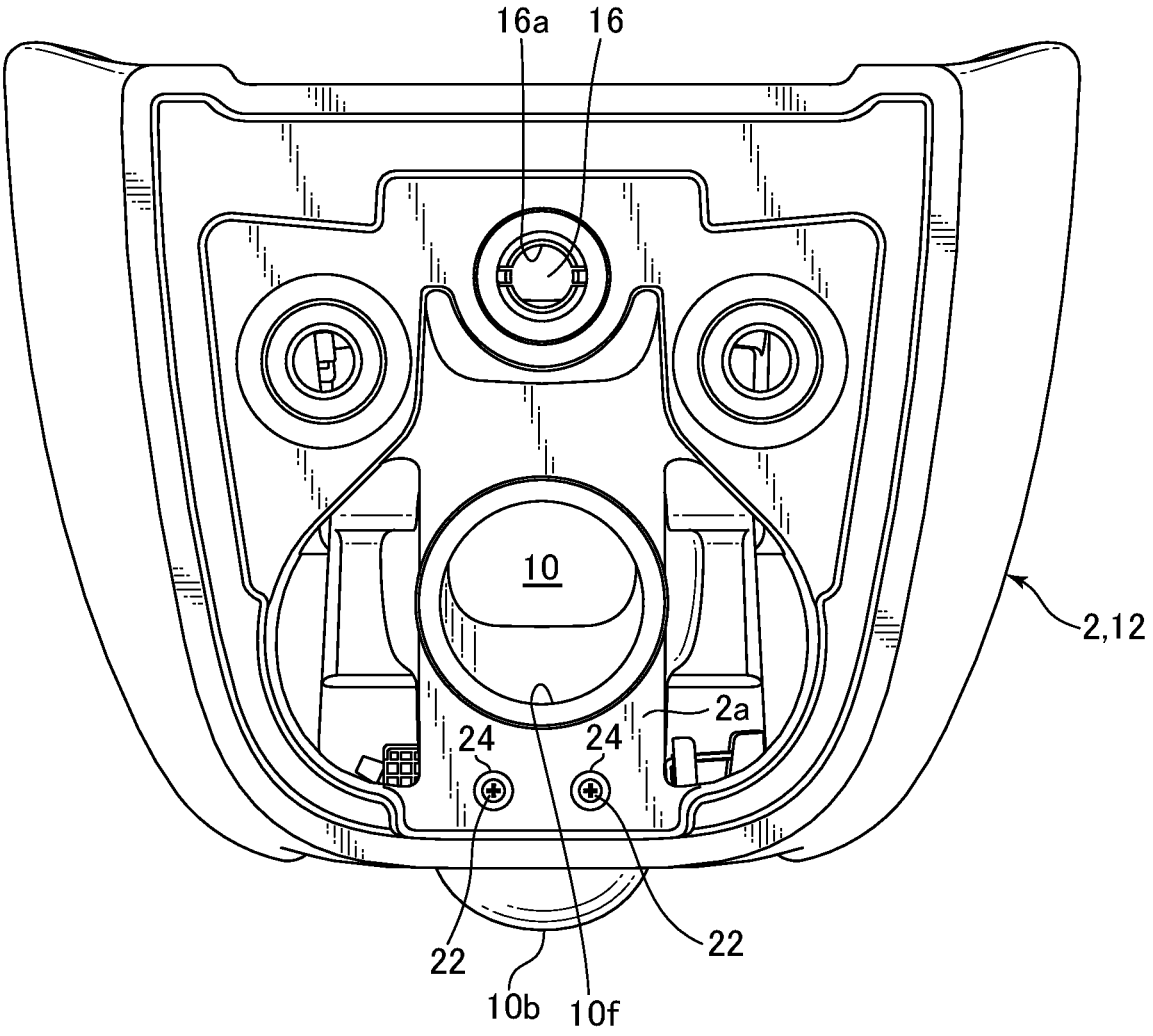
FIG. 4 is a rear view of the wall-mounted flush toilet according to the first embodiment of the present invention.

According to the wall-mounted flush toilet 1 of the present embodiment, as shown in FIGS. 4 and 8, the illuminating device 14 is fixed with the pair of fastening members (tapping screws 22, 22, washers 24, 24) from behind the rear wall part 2*a* of the toilet main body 2. Consequently, a fixing location or the fastening members (tapping screws 22, 22, washers 24, 24) behind the rear wall part 2*a* of the toilet main body 2 where the illuminating device 14 is fixed with the fastening members (tapping screws 22, 22, washers 24, 24) can be hidden from user's view.

According to the illuminating device 14 of the wall-mounted flush toilet 1 of the present embodiment described above, the light L emitted from the light source (light source 34*a*) of the light emitter (LED board 34) transmits through the translucent cover 40 covering the light emitter (LED board 34) and is emitted to the floor surface F below the toilet main body 2, so that a space or the floor surface F below the toilet main body 2 can be brightly illuminated. Since the translucent cover 40 fixed to the rear wall part 2*a* of the toilet main body 2 with the fixing part of the illuminating device 14 (fixing part 30*a* of the housing 30) is made of the single member having the exposed surface portion formed integrally without any cut, risk of dirt entering the cut in the surface portion of the translucent cover 40 can be eliminated. Furthermore, even if dirt adheres to the surface portion of the translucent cover 40, the translucent cover 40 composed of the single member formed integrally without any cut can facilitate a wipe-off work of the surface portion, or the like and can enhance cleanability.

According to the illuminating device 14 of the wall-mounted flush toilet 1 of the present embodiment, the fixing member (board member 34*b*) itself fixing the light source (LED element 34*a*) of the light emitter (LED board 34) within the translucent cover 40 is provided to shield the light source (LED elements 34*a*) from above so that the light L emitted from the light source (LED elements 34*a*) does not diffuse upward. Consequently, the board member 34*b* itself can inhibit upward diffusion of the light L emitted from the light source (LED elements 34*a*) of the light emitter (LED board 34), and the housing 30 itself, made of the light-shielding material can block light circling around the LED board 34 and leaking upward, reduce generation of unnecessary reflected light or shadow, and reliably diffuse light to the floor surface F below the toilet main body 2.

According to the illuminating device 14 of the wall-mounted flush toilet 1 of the present embodiment, the light shield 30*d* of the housing 30 disposed below the light source (LED element 34*a*) of the light emitter (LED board 34) includes the opening 30*e* formed to allow the light L emitted from the light source (LED element 34*a*) to transmit and penetrate the opening. Consequently, brightness of the light L passing through the opening 30*e* can be adjusted, and directivity of the light L can be enhanced by passing the light L through the opening 30*e* of the light shield 30*d*, when the light L emitted from the light source (LED element 34*a*) of the light emitter (LED board 34) passes through the opening 30*e* of the light shield 30*d* of the housing 30 and is emitted to the floor surface F below the toilet main body 2.

According to the illuminating device 14 of the wall-mounted flush toilet 1 of the present embodiment, the auxiliary light shielding member (body-side waterproof packing 38) provided between the fixing member (housing 30) and the translucent cover 40 can eliminate the gap between the housing 30 and the translucent cover 40 in the front-rear direction. Therefore, the light L emitted from the light source (LED element 34*a*) of the light emitter (LED board 34) can be inhibited from being emitted to the floor surface F below the toilet main body 2 from a portion other than the opening 30*e* of the light shield 30*d*.

According to the illuminating device 14 of the wall-mounted flush toilet 1 of the present embodiment, the irradiation surface (lower surface 40*a*) of the translucent cover 40 is formed almost flat. Consequently, a spot of the light L focused on the specific region A on the floor surface F can be effectively formed when the light L emitted from the light source (LED element 34*a*) of the light-emitter (LED board 34) is transmitted through the irradiation surface (lower surface 40*a*) of the translucent cover 40 and is emitted to the floor surface F below the toilet main body 2.

According to the illuminating device 14 of the wall-mounted flush toilet 1 of the present embodiment, it is possible to provide the wall-mounted flush toilet 1 provided with the illuminating device 14 capable of brightly illuminating a space or floor surface F below the toilet main body 2 and enhancing cleanability.

In the illuminating device 14 of the wall-mounted flush toilet 1 of the present embodiment described above, the form of the illuminating device 14 provided within the internal space S of the toilet main body 2, behind the lowermost end 10*b* of the discharge trap 10 in the toilet main body 2 and above the lower end 12*a* of the skirt 12 has been described, but this form is not restrictive. The illuminating device 14 may be provided on the wall W behind the toilet main body 2 or a location of the cabinet below the toilet main body 2 so that the illuminating device 14 is hidden from the view of the user of the toilet main body 2.

Figure 12:
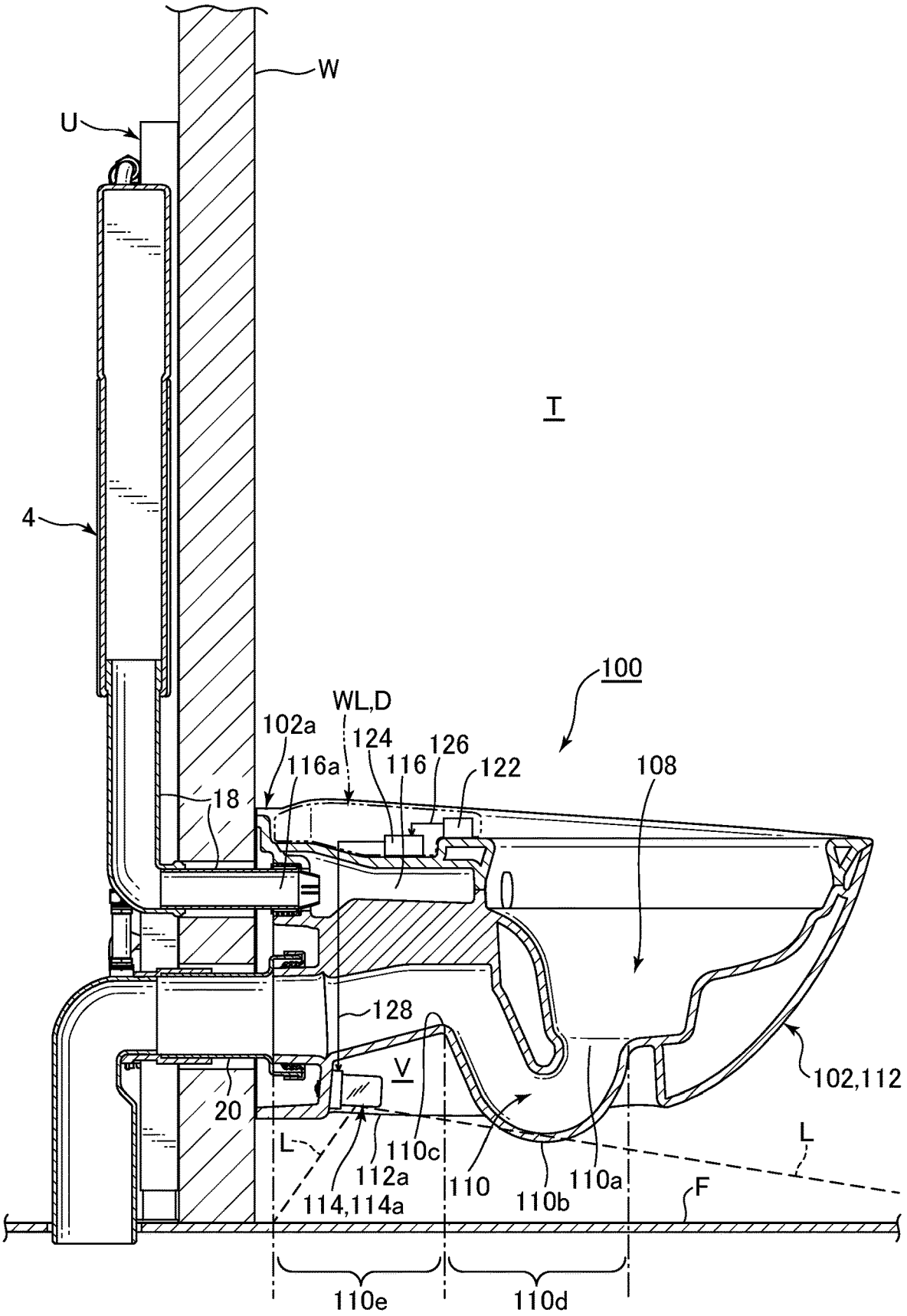
FIG. 12 is a central side cross-sectional view showing a state where the wall-mounted flush toilet according to the second embodiment of the present invention is fixed to the wall.

Next, with reference to FIGS. 11 to 17, a wall-mounted flush toilet according to a second embodiment of the present invention will be described. In a flush toilet 100 according to the second embodiment of the present invention shown in FIGS. 11 to 17, the same portions as in the flush toilet 1 according to the first embodiment of the present invention described above are given the same numerals, and these descriptions are omitted. First, as shown in FIGS. 11 to 13 and 15, in a toilet main body 102 of the wall-mounted flush toilet 100 of the present embodiment, an illuminating device 114, as will be described later in detail, is provided within an internal space V of the toilet main body 102, behind a lowermost end 110*b* of a discharge trap 110 and above a lower end 112*a* of a skirt 112. The illuminating device 114 is fixed to a rear wall part 102*a* of the toilet main body 102 and can emit light to a floor surface F below the toilet main body 102. As shown in FIGS. 12 and 14, light L emitted from an illuminating device main body 114*a* of the illuminating device 114 is blocked by a part of the toilet main body 102 (for example, a part of the discharge trap 110 or the like) and can form a shadow S100 for guiding a user M to a standing position with respect to the floor surface F in front of the toilet main body 102.

Next, as shown in FIGS. 11, 12, 14 and 15, in the toilet main body 102 in a state of the ceramic toilet main body 102 fixed to a wall W with a fixing unit U, an inlet 116*a* that is an upstream end (rear end) of a main water conduit 116 formed upstream of a bowl 108 is connected to a water supply pipe 18 extending downstream from a reservoir tank 4*a* of a flush water supply device 4. In the toilet main body 102 in the state of the ceramic toilet main body 102 fixed to the wall W with the fixing unit U, an exit 110*f* that is a downstream end (rear end) of the discharge trap 110 is connected to a discharge pipe 20 extending upward from the floor surface F on the back of the wall W and then bending and extending forward. The wall-mounted flush toilet 100 of the present embodiment may be in a form of a so-called "wash-away type" of flush toilet that washes away waste in the bowl 108 by use of water drop in a height direction of the bowl 108 within the toilet main body 102, a so-called "siphon type" of flush toilet that takes in waste in the bowl 108 by use of siphon action to discharge the waste outward from the discharge trap 110, or another type of flush toilet.

As shown in FIGS. 12 and 14, a functional part D including a private part washing device WL or the like for washing the private part of the user M is provided behind and above the bowl 108 in an upper surface of the toilet main body 102. The functional part D further includes a human body detection sensor 122 and a controller 124. The human body detection sensor 122 is a sensor provided on a part of a front of the functional part D, to detect a position of the user M of the flush toilet 100. The controller 124 is a controller capable of controlling an operation of the private part washing device WL or the like and controlling the illuminating device main body 114*a*. The controller 124 transmits, to the illuminating device main body 114*a*, a signal 128 that changes the light L emitted from the illuminating device main body 114*a* based on a signal 126 transmitted from the human body detection sensor 122. Additionally, as shown in FIG. 14, a detection range A0 of the human body detection sensor 122 is a semicircular detection range A0 with a radius R1 (for example, R1=300 mm) around a center O101 in a left-right width direction in a front end 102*b* of the toilet main body 102 in plan view. Further, the illuminating device 114 is electrically connected to a power source (not shown) of the functional part D via a power supply cable (not shown).

Next, with reference to FIGS. 12 to 17, details of the illuminating device 114 of the wall-mounted flush toilet 100 according to the present embodiment will be described. First, as shown in FIGS. 12 to 16, the main body 114*a* of the illuminating device 114 is disposed behind the front end 102*b* of the toilet main body 102 and is disposed below and behind the toilet main body 102, and more specifically the illuminating device main body is provided within the internal space V of the toilet main body 102 below a descending conduit 110*e* of the discharge trap 110 of the toilet main body 102. As shown in FIG. 16, the main body 114*a* of the illuminating device 114 is fixed to the front of the rear wall part 102*a* of the toilet main body 102, and a center L100 of the light L to be emitted is disposed to be located in front of the rear wall part 102*a* of the toilet main body 102.

As shown in FIG. 16, the main body 114*a* of the illuminating device 114 is disposed so that light L101 emitted forwardmost is emitted forward of the lowermost end 110*b* while overlapping a part of a bent conduit 110*d* of the discharge trap 110 of the toilet main body 102 (the lowermost end 110*b* of the bent conduit 110*d* or the like). Further, as shown in FIG. 16, the main body 114*a* of the illuminating device 114 is disposed so that the center L100 of the light L to be emitted is located in front of the lowermost end 110*b* of the discharge trap 110 of the toilet main body 102.

Consequently, since the light L emitted from the main body 114*a* of the illuminating device 114 is blocked by a part of the toilet main body 102, the shadow S100 for guiding the user M is formed with respect to the floor surface F in front of the toilet main body 102. The light L emitted from the illuminating device main body 114*a* is emitted to a predetermined floor surface region A101 directly under the toilet main body 102 behind the shadow S100 of the floor surface F and before and behind the lowermost end 110*b* of the discharge trap 110, and a center O102 of an irradiation region of the light L is disposed within the predetermined floor surface region A101 directly under the toilet main body 102.

Figure 13:
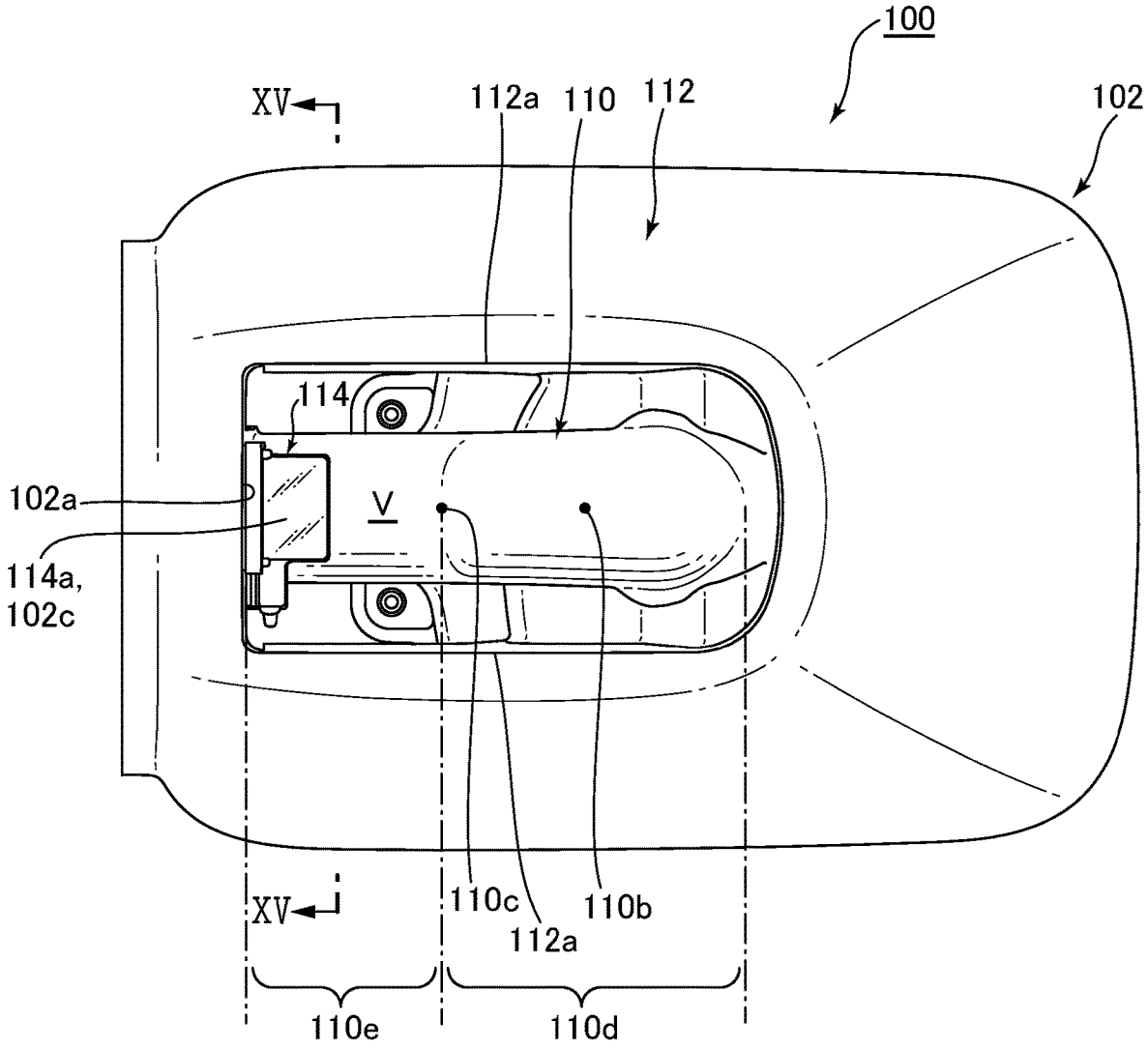
FIG. 13 is a bottom view of the wall-mounted flush toilet according to the second embodiment of the present invention.
Figure 14:
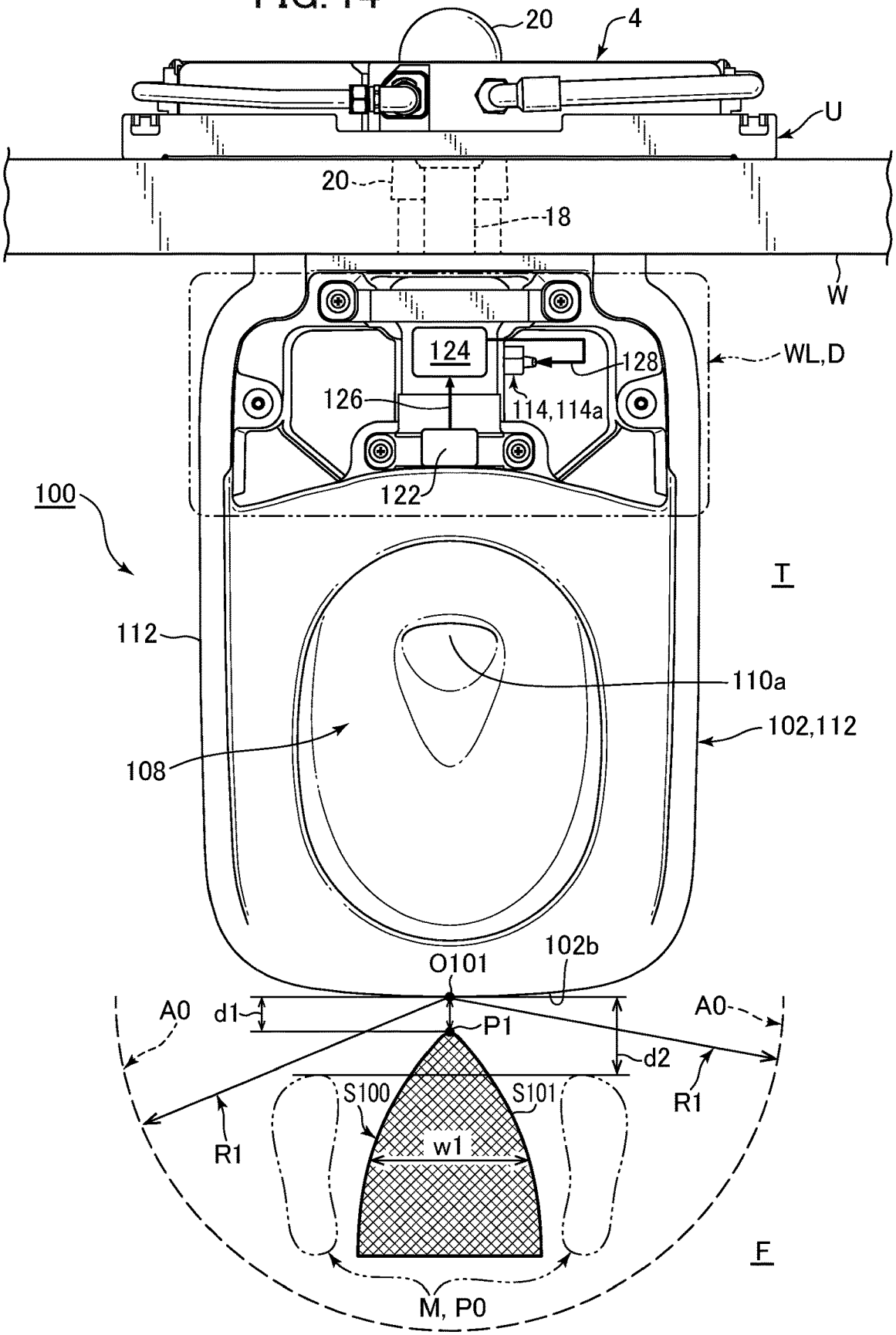
FIG. 14 is a plan view of the wall-mounted flush toilet according to the second embodiment of the present invention.
Figure 15:
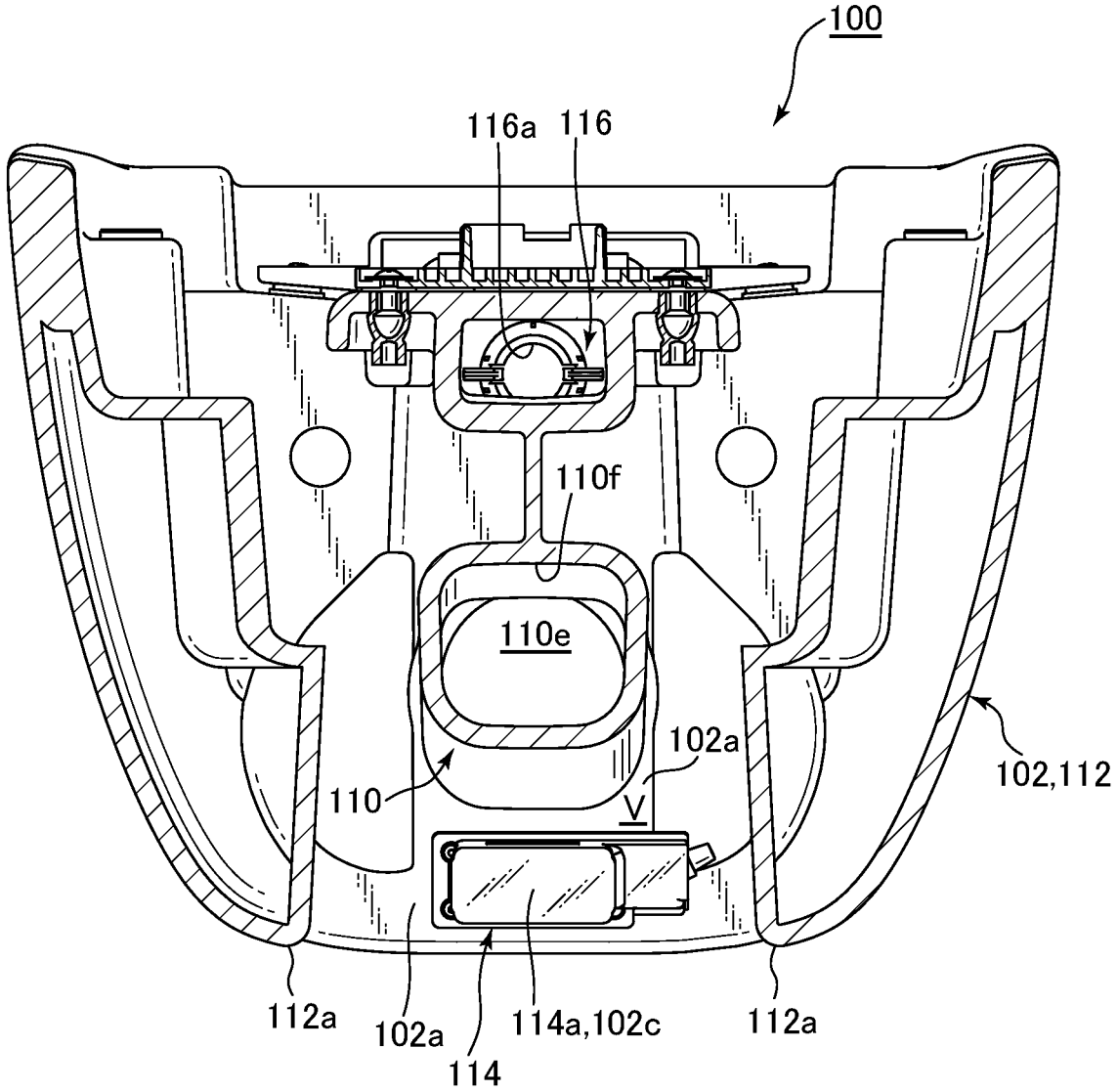
FIG. 15 is a cross-sectional view along the XV-XV line of FIG. 13.
Figure 16:
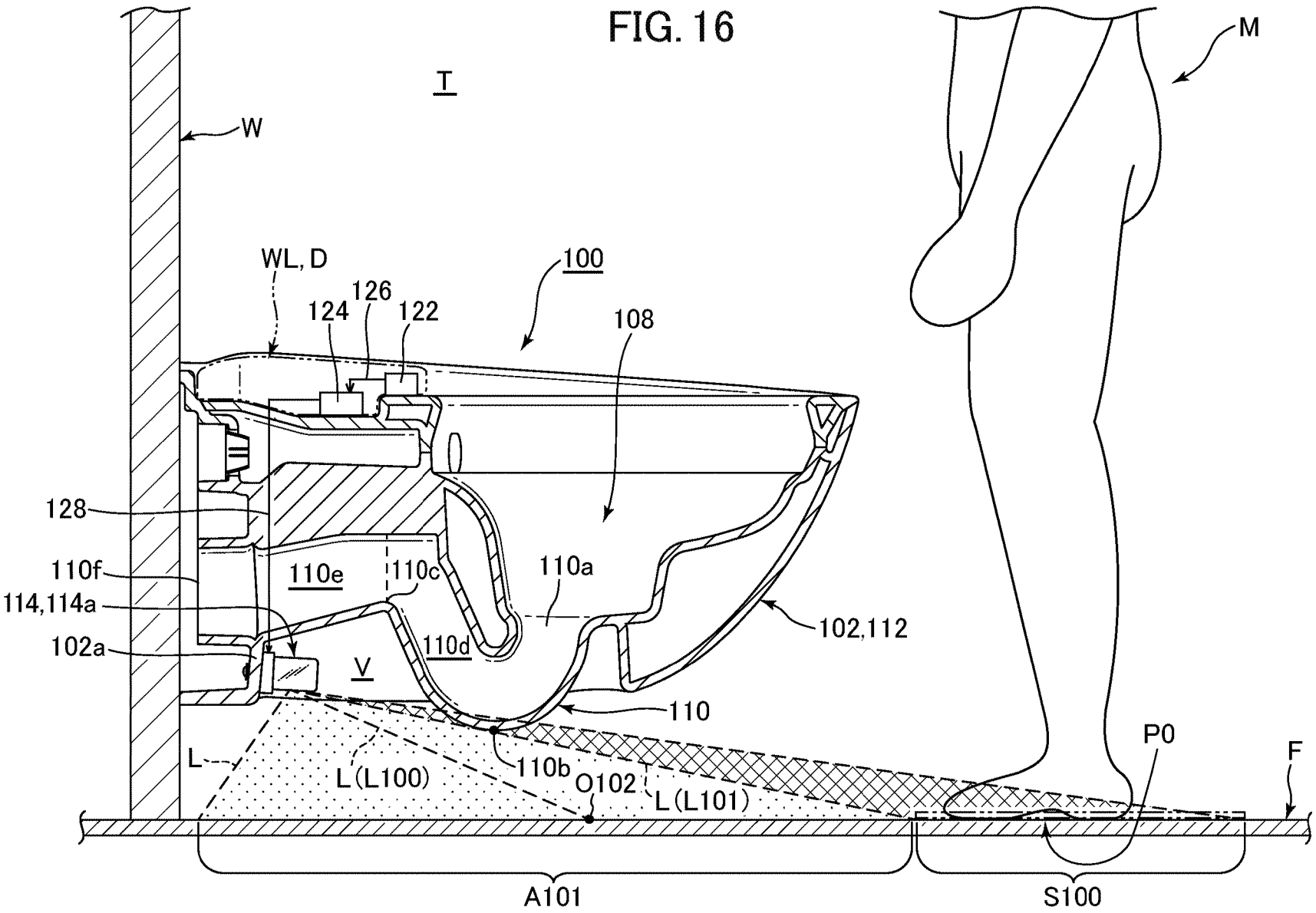
FIG. 16 is a schematic central side cross-sectional view of the wall-mounted flush toilet according to the second embodiment of the present invention and shows a state where the illuminating device emits light to the floor surface to form a shadow for guiding a user to the floor surface in front of a toilet main body.
Figure 17:
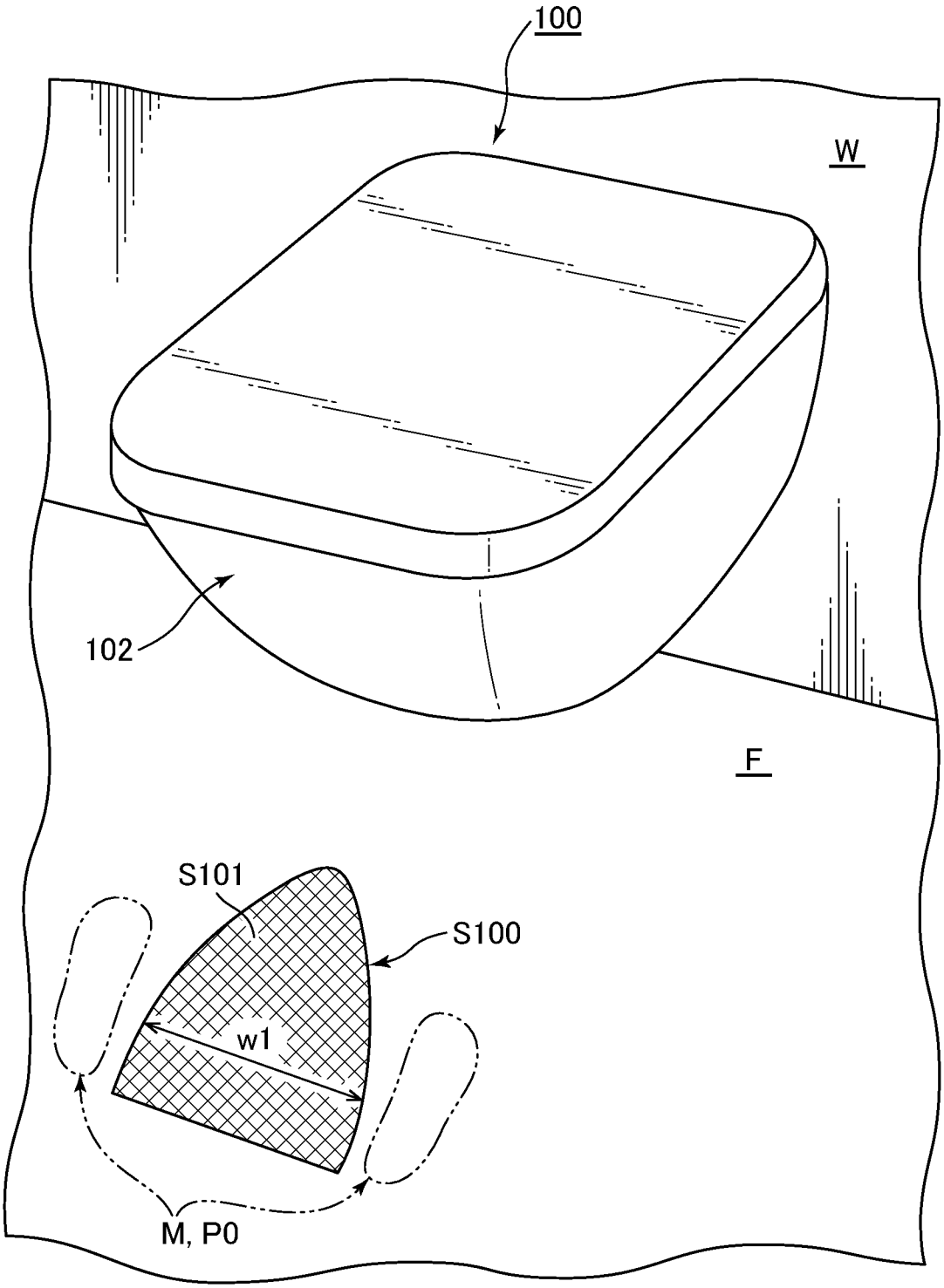
FIG. 17 is a schematic perspective view of the wall-mounted flush toilet according to the second embodiment of the present invention and shows a state where an illuminating device emits light to the floor surface to form a shadow for guiding the user to the floor surface in front of the toilet main body.

Further, as shown in FIGS. 13 to 15, the main body 114*a* of the illuminating device 114 is disposed in a central portion 102*c* of the toilet main body 102 in the left-right width direction. Thus, as shown in FIGS. 14 and 17, when the shadow S100 is formed on the floor surface F in front of the toilet main body 102 by light emitted from the main body 114*a* of the illuminating device 114, the shadow S100 has a shape that expands a width w1 in a left-right direction as being away from the toilet main body 102.

Next, with reference to FIGS. 11 to 17, an operation of the illuminating device 114 of the wall-mounted flush toilet 100 according to the second embodiment of the present invention will be described. According to the illuminating device 114 of the wall-mounted flush toilet 100 of the present embodiment described above, the main body 114*a* of the illuminating device 114 provided in the flush toilet 100 is disposed behind the front end 102*b* of the toilet main body 102. Consequently, the light L emitted from the main body 114*a* of the illuminating device 114 is blocked by a part of the toilet main body 102 and capable of forming the shadow S100 for guiding the user M to the floor surface F below the flush toilet 100 within the toilet room T. Even if it is dark within the toilet room T, the user M can be reliably guided to a proper fixed position P0 on the floor surface F below the flush toilet 100 within the toilet room T. Therefore, for example, when the user (male) M urinates toward an interior of the bowl 108 of the toilet main body 102 of the flush toilet 100, guidance by the shadow S100 can properly keep a distance d1 in a front-rear direction between the center O101 of the front end 102*b* of the toilet main body 102 in the left-right width direction and a tip (rear end) P0 of the shadow S100, and a distance d2 between the user M and the front end 102*b* of the toilet main body 102 from the toilet main body, and urine bounce and splash from the toilet main body 102 can be suppressed.

According to the illuminating device 114 of the wall-mounted flush toilet 100 of the present embodiment, the main body 114*a* of the illuminating device 114 is disposed below and behind the toilet main body 102. Consequently, the light L emitted from the main body 114*a* of the illuminating device 114 can form the shadow S100 for guiding the user M to the floor surface F in front of the toilet main body 102 of the flush toilet 100. Even if it is dark within the toilet room T, the user M can grasp the standing position P0 of the user M and the relative distance d2 between this standing position P0 and the toilet main body 102 by visually checking the shadow S100 on the floor surface F in front of the toilet main body 102. The user M can be guided more reliably to the proper fixed position P0 on the floor surface F in front of the toilet main body 102 of the flush toilet 100 within the toilet room T without directly looking at bright light. Therefore, for example, when guided by the shadow S100 to the proper fixed position P0 on the floor surface F in front of the toilet main body 102 to urinate toward the interior of the bowl 108 of the toilet main body 102, the user M can properly keep the distance d2 between the user M and the toilet main body 102, and urine bounce and splash from the toilet main body 102 can be suppressed.

According to the illuminating device 114 of the wall-mounted flush toilet 100 of the present embodiment, the main body 114*a* is disposed in the central portion 102*c* of the toilet main body 102 of the flush toilet 100 in the left-right width direction and can form the shadow S100 that expands the width w1 in the left-right direction as being away from the toilet main body 102. Consequently, for example, when the user M urinates toward the interior of the bowl 108 of the toilet main body 102, the user can easily grasp the central portion 102*c* of the toilet main body 102 in the left-right width direction, and the user M can be easily guided to the proper fixed position P0 near the center of the toilet main body 102 in the left-right width direction in the floor surface F in front of the toilet main body 102 of the flush toilet 100 within the toilet room T. To urinate toward the interior of the bowl 108 of the toilet main body 102, the user M can keep the distance d2 between the user M and the toilet main body 102, and the position of the center O101 of the front end 102*b* of the toilet main body 102 in the left-right width direction. Therefore, urine scattering to the toilet main body 102 can be suppressed, and the bounce and splash of urine from the toilet main body 102 can be suppressed.

According to the illuminating device 114 of the wall-mounted flush toilet 100 of the present embodiment, the main body 114*a* is disposed behind the lowermost end 110*b* of the discharge trap 110 of the toilet main body 102. Thereby, part of the light L emitted from the main body 114*a* of the illuminating device 114 is blocked by the discharge trap 110 of the toilet main body 102, and the shadow S100 for guiding the user M to the floor surface F in front of the toilet main body 102 of the flush toilet 100 can be reliably formed. Consequently, for example, when guided by the shadow S100 to the proper fixed position P0 on the floor surface F in front of the toilet main body 102 to urinate toward the interior of the bowl 108 of the toilet main body 102, the user M can properly keep the distance d2 between the user and the toilet main body 102, and urine bounce and splash from the toilet main body 102 can be suppressed.

According to the illuminating device 114 of the wall-mounted flush toilet 100 of the present embodiment, the controller 124 that controls the main body 114*a* can change the light L emitted from the main body 114*a* of the illuminating device 114 (for example, illuminance of light, flashing of light, color of light, and the like) based on the signal 126 obtained from the human body detection sensor 122 that detects the position of the user M. The light L from the main body 114*a* of the illuminating device 114 that is changed by the controller 124 can form the shadow S100 for guiding the user M to the floor surface F below the flush toilet 100 within the toilet room T. For example, when the user M who has entered the toilet room T enters the detection range A0 of the human body detection sensor 122, the human body detection sensor 122 detects presence of the user M, and then a power source (not shown) of the illuminating device 114 turns on. Thereby, the light L is emitted to the predetermined floor surface region A101 below the flush toilet 100 from the main body 114*a* of the illuminating device 114. At this time, the user M within the detection range A0 cannot directly look at the light L emitted from the main body 114*a* of the illuminating device 114. However, the closer to the toilet main body 102 the user M within the detection range A0 comes, the larger the illuminance of the light L emitted from the main body 114*a* of the illuminating device 114 becomes. An outline S101 of the shadow S100 is clearly reflected on the floor surface F. Subsequently, when the user M within the detection range A0 stands at the proper standing position (fixed position) P0, the controller 124 receiving the signal 126 from the human body detection sensor 122 detecting the standing determines that the distance d2 between the user M and the toilet main body 102 is a proper distance, transmits the signal 128 that flashes the light L to the main body 114*a* of the illuminating device 114, and informs the user M of the proper standing position P0. Even if it is dark within the toilet room T, the user M can see the outline S101 of the shadow S100 projected on the floor surface F below and in front of the flush toilet 100 and can grasp whether the user is at the proper fixed position P0 on the floor surface F below and in front of the flush toilet 100, and the user M can be reliably guided to the fixed position P0 on the floor surface F below the flush toilet 100 within the toilet room T. Therefore, for example, when guided by the shadow S100 to urinate toward the interior of the bowl 108 of the toilet main body 102, the user M can properly keep the distance d2 between the user M and the toilet main body 102, and the urine bounce and splash from the toilet main body 102 can be suppressed.

According to the illuminating device 114 of the wall-mounted flush toilet 100 of the present embodiment, the present invention can provide the wall-mounted flush toilet 100 including the illuminating device 114 capable of reliably guiding the user M to the proper fixed position P0 on the floor surface F below the flush toilet 100 within the toilet room T when the user M urinates toward the interior of the bowl 108 of the toilet main body 102 and capable of suppressing urine bounce and splash from the toilet main body 102.

In the illuminating device 114 of the wall-mounted flush toilet 100 of the present embodiment described above, a form of the illuminating device 114 provided within the internal space V of the toilet main body 102 behind the lowermost end 110*b* of the discharge trap 110 in the toilet main body 102 and above the lower end 112*a* of the skirt 112 has been described, but such a form is not restrictive. As another embodiment, the illuminating device 114 may be provided at a location or the like on a wall W side, on a cabinet side or inside a wall surface behind the toilet main body 102 to hide the illuminating device 114 from user's view of the toilet main body 102. According to the illuminating device 114 of such other embodiment, the invention can provide the cabinet provided behind the flush toilet 100 and including the illuminating device 114 capable of reliably guiding the user M to the proper fixed position P0 on the floor surface F below the flush toilet 100 within the toilet room T when the user M urinates toward the interior of the bowl 108 of the toilet main body 102 and capable of suppressing urine bounce and splash from the toilet main body 102.

Although the present disclosure has been explained with reference to specific, preferred embodiments, one of ordinary skill in the art will recognize that modifications and improvements can be made while remaining within the scope and spirit of the present disclosure. The scope of the present disclosure is determined solely by appended claims.

What is claimed is:

1. A wall-mounted flush toilet comprising:

a toilet main body fixed to a wall and disposed above a floor surface; and an illuminating device attached to the toilet main body, the illuminating device being configured to emit light to the floor surface, wherein the toilet main body includes a bowl configured to receive waste, a discharge trap having an inlet connected below the bowl to discharge waste in the bowl, a skirt configured to cover sides of the bowl and the discharge trap, and a rear wall part formed behind the skirt and fixed to the wall, and wherein the discharge trap includes a bent conduit and a descending conduit, the bent conduit being descending to a lowermost end below and behind the inlet and then ascending rearward to a top portion, and the descending conduit being descending rearward from the top portion, and the illuminating device is provided within an internal space provided behind the lowermost end of the discharge trap and above a lower end of the skirt, the illuminating device being fixed to the toilet main body within the internal space of the toilet main body.

2. The wall-mounted flush toilet according to claim 1, wherein the illuminating device is provided within the internal space behind the ascending bent conduit of the discharge trap and below the descending conduit.

3. The wall-mounted flush toilet according to claim 1, wherein the illuminating device is disposed so that the center of light of a maximum illuminance to be emitted is located in front of the rear wall part.

4. The wall-mounted flush toilet according to claim 1, wherein the illuminating device is disposed so that the emitted light is emitted forward of the lowermost end without overlapping the lowermost end of the discharge trap.

5. The wall-mounted flush toilet according to claim 4, wherein the illuminating device is disposed so that the center of light of a maximum illuminance to be emitted is located behind the lowermost end of the discharge trap.

6. The wall-mounted flush toilet according to claim 4, wherein the toilet main body includes a wall surface defining the internal space provided with the illuminating device, and a surface of at least a part of the wall surface is coated with glaze.

7. The wall-mounted flush toilet according to claim 4, wherein the illuminating device comprises:

a fixing part fixed to the toilet or a cabinet behind the toilet, a light emitter including a light source attached to the fixing part and emitting light, and a translucent cover formed of a translucent material and covering the light emitter, wherein the translucent cover in a state of being fixed to the toilet or the cabinet with the fixing part is composed of a single member having an exposed surface portion formed integrally without any cut.

8. The wall-mounted flush toilet according to claim 7, further comprising a fixing member configured to fix the light source within the translucent cover, wherein the fixing member is provided to shield the light source from above so that light emitted from the light source does not diffuse upward.

9. The wall-mounted flush toilet according to claim 8, further comprising a light shield disposed below the light source, wherein the light shield includes an opening formed to allow light emitted from the light source to transmit and penetrate the opening.

10. The wall-mounted flush toilet according to claim 9, further comprising an auxiliary light shielding member provided between the fixing member and the translucent cover.

11. The wall-mounted flush toilet according to claim 7, wherein the translucent cover has an irradiation surface formed almost flat.

12. The wall-mounted flush toilet according to claim 9, wherein the illuminating device includes an illuminating device main body provided within the flush toilet or within a cabinet or wall surface behind the flush toilet, and wherein the illuminating device main body is disposed behind a front end of the toilet main body and a part of the toilet main body is configured to form a shadow for guiding a user to the floor surface by blocking light emitted from the illuminating device main body.

13. The wall-mounted flush toilet according to claim 12, wherein the illuminating device main body is disposed below and behind the toilet main body and is configured to form a shadow for guiding the user to the floor surface in front of the toilet main body.

14. The wall-mounted flush toilet according to claim 13, wherein the illuminating device main body is disposed in a central portion of the toilet main body in a left-right width direction and is configured to form a shadow that expands a width in a left-right direction as being away from the toilet main body.

15. The wall-mounted flush toilet according to claim 13, wherein the illuminating device main body is disposed behind the lowermost end of the discharge trap and configured so that light emitted from the illuminating device main body is blocked by the discharge trap to form a shadow.

16. The wall-mounted flush toilet according to claim 12, further comprising a human body detection sensor that detects a position of the user and a controller that controls the illuminating device main body, wherein the controller changes the light emitted from the illuminating device main body based on a signal obtained from the human body detection sensor.

* * * * *